US008726437B2

(12) United States Patent
Hardesty

(10) Patent No.: US 8,726,437 B2
(45) Date of Patent: May 20, 2014

(54) APPARATUS FOR CARE OF INFANT

(76) Inventor: Clifford Allen Hardesty, Cedar Park, TX (US)

( * ) Notice: Subject to any disclaimer, the term of this patent is extended or adjusted under 35 U.S.C. 154(b) by 0 days.

(21) Appl. No.: 12/610,785

(22) Filed: Nov. 2, 2009

(65) Prior Publication Data

US 2011/0099719 A1 May 5, 2011

(51) Int. Cl.
*A47C 20/02* (2006.01)

(52) U.S. Cl.
USPC ..... 5/655; 5/494; 5/923; 2/69.5

(58) Field of Classification Search
USPC ..... 5/655, 494, 491, 482, 923, 69.5; 2/69.5
See application file for complete search history.

(56) References Cited

U.S. PATENT DOCUMENTS

| | | | | |
|---|---|---|---|---|
| 5,129,406 | A | 7/1992 | Magnusen et al. | |
| 5,722,094 | A | 3/1998 | Ruefer | |
| 6,341,397 | B1 | 1/2002 | Kliegl et al. | |
| 6,553,590 | B1 * | 4/2003 | Leach | 5/655 |
| 6,640,340 | B2 | 11/2003 | Gibson | |
| 6,662,390 | B1 | 12/2003 | Berger | |
| 6,868,566 | B2 | 3/2005 | Gatten | |
| 6,928,674 | B2 | 8/2005 | Blackburn | |
| 6,948,200 | B2 | 9/2005 | Wyman | |
| 7,043,783 | B2 | 5/2006 | Gatten | |
| 7,181,789 | B2 | 2/2007 | Gatten | |
| 7,246,392 | B2 | 7/2007 | Schmid et al. | |
| 7,254,849 | B1 | 8/2007 | Fiebrich et al. | |
| 7,587,769 | B1 | 9/2009 | McDermott | |
| 8,191,188 | B2 | 6/2012 | Kaplan et al. | |
| 2003/0131411 | A1 | 7/2003 | Gibson | |
| 2004/0019969 | A1 * | 2/2004 | Gatten | 5/482 |
| 2004/0216230 | A1 | 11/2004 | Blackburn | |
| 2005/0097671 | A1 | 5/2005 | Wyman | |
| 2005/0125895 | A1 | 6/2005 | Gatten | |
| 2005/0210585 | A1 | 9/2005 | French | |
| 2006/0010600 | A1 | 1/2006 | Kendy | |
| 2006/0150330 | A1 | 7/2006 | Gatten | |
| 2007/0056098 | A1 | 3/2007 | Schmid et al. | |
| 2009/0064390 | A1 | 3/2009 | Beiring et al. | |
| 2009/0249526 | A1 | 10/2009 | Carangelo | |
| 2011/0179546 | A1 | 7/2011 | Millette et al. | |
| 2011/0180079 | A1 | 7/2011 | Krawchuk | |
| 2011/0191932 | A1 | 8/2011 | Earnest | |

FOREIGN PATENT DOCUMENTS

JP 2008255533 A * 10/2008 ..... A41B 13/06

OTHER PUBLICATIONS

Translation of JP2008255533.*
Office Action mailed Sep. 18, 2013 for U.S. Appl. No. 13/103,508.
International Search Report & Written Opinion, PCT/US2010/055972, mailed Jan. 10, 2011.

* cited by examiner

*Primary Examiner* — Brittany Wilson
(74) *Attorney, Agent, or Firm* — Kevin L. Daffer; Daffer McDaniel LLP

(57) ABSTRACT

Embodiments provide apparatus for care of an infant, the apparatus including a comfort support for returning legs of an infant to fully folded positions relative to the torso.

23 Claims, 11 Drawing Sheets

800

APPARATUS FOR CARE OF INFANT

FIELD OF THE INVENTION

The disclosure relates to apparatus for care of infants.

BACKGROUND OF THE INVENTION

Newborns and infants (hereinafter "infants") generally benefit from periods of sleep. In some aspects, apparatus for care of infants are deficient in promoting periods of sleep. Newborns and infants (hereinafter "infants") generally benefit from periods of rest. In some aspects, apparatus for care of infants are deficient in promoting periods of rest. For the reasons stated above, and for other reasons stated below which will become apparent to those skilled in the art upon reading and understanding the specification, there is a need in the art for improved apparatus for care of infants.

BRIEF DESCRIPTION OF THE INVENTION

The above-mentioned shortcomings, disadvantages and problems are addressed herein, which will be understood by reading and studying this specification. In one aspect, embodiments provide apparatus for care of an infant which promote uninterrupted periods of sleep. In one aspect, embodiments provide apparatus for care of an infant which promote relatively undisturbed sleep. In one aspect, embodiments provide apparatus for care of an infant which promote uninterrupted periods of rest. In one aspect, embodiments provide apparatus for care of an infant which promote relatively undisturbed rest.

Apparatus and methods of varying scope are described herein. In addition to the aspects and advantages described in this summary, further aspects and advantages will become apparent by reference to the drawings and by reading the detailed description that follows.

DETAILED DESCRIPTION OF THE INVENTION

In this detailed description, reference is made to the accompanying drawings that form a part hereof, and in which is shown by way of illustration specific embodiments which can be practiced. Sufficient detail is described to enable those of ordinary skill to practice the embodiments. It is to be understood that, by reference to the present disclosure, other embodiments can also be practiced by those of ordinary skill. It is to be understood that logical, mechanical and other changes can be made without departing from the scope of the embodiments and the disclosure. The following detailed description is, therefore, not to be taken in a limiting sense.

Newborns and infants (hereinafter "infants") generally benefit from periods of sleep. It will be understood that, as used herein, the term "sleep" is intended to be construed broadly to refer, generally, to any state of rest or sleep, without respect to potential distinctions between states of consciousness. As used herein, the term "sleep" is intended to include, but is not limited to, any state of reduced consciousness in which a human rests. It will be understood that, as used herein, the term "sleep" can also include, but is not limited to, various waking states associated with rest, such as, for example, drowsing states of rest and partially waking states of rest. It will be understood that, as used herein, the term "sleep" can also include, but is not limited to, any state of rest or calm.

It is beneficial for various reasons to promote long periods of uninterrupted or continuous sleep for infants. As used herein, "continuous" is intended to describe that an infant sleeps continuously, i.e., without waking, during a period. In other words, an infant is said to sleep "continuously" when a period of sleep is not interrupted by early waking and is not broken up into a plurality of shorter periods of sleep separated by alternating waking periods. It will be understood that the term "continuous sleep" can include a period of sustained deep sleep. It is also beneficial to promote relatively undisturbed sleep by infants. As used herein, "undisturbed" is intended to describe that during sleep or rest, an infant remains relatively quiet, motionless, at ease, and comfortable, and thus does not exhibit restlessness, excessive movement, discomfort, or startled actions in the absence of external stimuli. As described herein, "undisturbed" also refers to the characteristic that, absent external stimuli, an infant does not stir to an extent that interferes with ongoing sleep, move in an uncomfortable manner, or emit cries or other sounds of complaint. It will be understood that the term "undisturbed sleep" can include achievement of QS (Quality Sleep), REM sleep, Stage III or Stage IV sleep.

Figure 1:
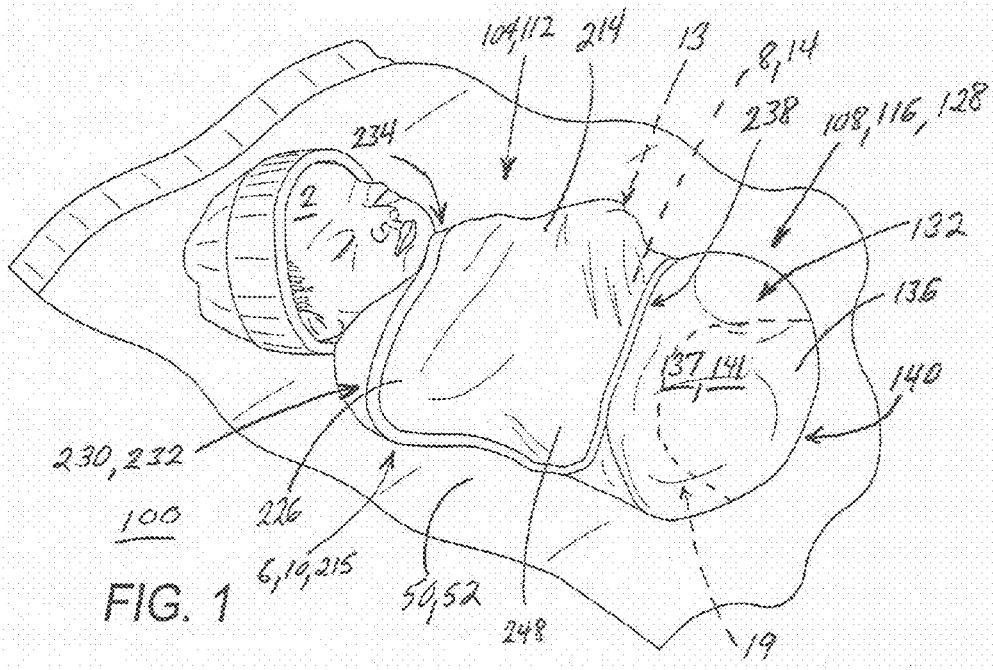
FIG. 1 is an elevated front perspective view of apparatus for care of an infant according to an embodiment, and an infant disposed therein with legs in a full fetal tuck position.
Figure 20:
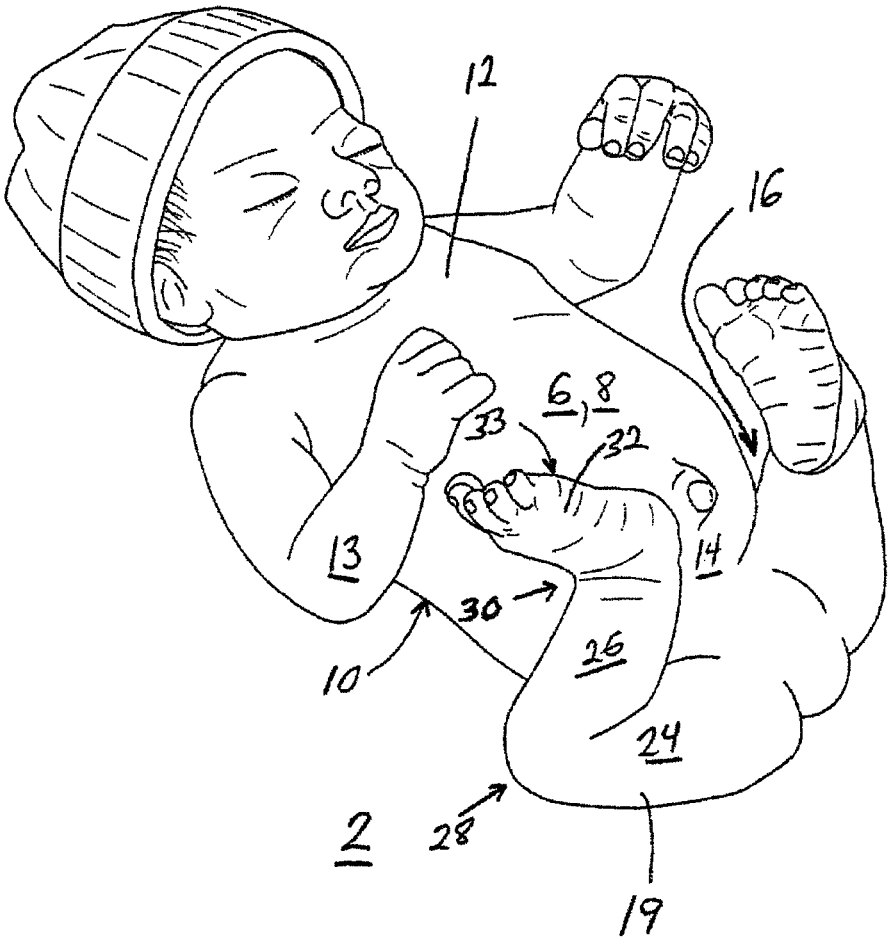
FIG. 20 is an elevated front perspective view of an infant as shown generally in FIG. 1, with legs of the infant occupying a full fetal tuck position.

FIG. 1 is an elevated front perspective view of apparatus 100 for care of an infant according to an embodiment, and having an infant 2 disposed with legs 19 in a full fetal tuck position in apparatus 100, as will be further described. Referring now to FIG. 20, infant 2 will be described in detail. FIG. 20 is a front elevated perspective view of the infant 2 shown generally in FIG. 1, with legs 19 of the infant occupying a full fetal tuck position. Infant 2 has a torso 6. Torso 6 has a front 8 and a back 10. Back 10 is spaced from the front 8 in general opposition thereto. Torso 6 includes an upper torso 12 and a lower torso 14. For purposes of this description and simplicity, upper torso 12 is defined to include also a neck, head and a pair of arms 13 of the infant 2. It will be appreciated that arms 13 can also be described as being independent of upper torso 12. Lower torso 14 adjoins the upper torso 12 and includes a pair of hips 16. Each hip 16 has in the interior thereof a hip socket (not shown). It will be understood that the pair of hips 16 are located adjacent each other in general opposition on respective sides of lower torso 14. Infant 2 has a generally identical pair of legs 19 joined to the lower torso 14 at the hips 16. Each leg 19 has an upper leg 24 and a lower leg 26. The leg 19 has a folding knee joint 28. The knee joint 28 is located intermediate the upper leg 24 and the lower leg 26. The lower leg 26 is supported by the knee joint 28 for folding motion relative to the upper leg 24 between a fully extended position (shown in FIG. 4) and a fully flexed position (illustrated in FIG. 20, FIG. 2 and FIG. 1). The lower leg 26 includes an ankle joint 30 spaced below the knee joint 28. Leg 19 includes a foot 32 which is joined to the lower leg 26 at the ankle joint 30. The foot 32 is supported by the ankle joint 30 for flexing motion of the foot 32 relative to the lower leg 26. The foot 32 is supported by the ankle joint 30 for flexing motion relative to the lower leg 26 between a fully extended position (not shown) and a fully flexed position illustrated in FIG. 4. The foot 32 has a foot sole 33 opposite the ankle joint 30. The upper leg 24 includes in the interior thereof a hip ball (not shown). The hip socket (not shown) of hip 16 captures the hip ball (not shown) to provide a flexible hip joint (not shown). The upper leg 24 is supported by the hip joint for flexing motion of the upper leg 24 relative to the lower torso 14 at hip 16. The upper leg 24 is supported by the hip joint for flexing motion relative to the lower torso 14 between a fully extended position (shown in FIG. 4), a partially flexed position shown in FIG. 3, and the fully flexed position (shown in FIG. 20, FIG. 2 and FIG. 1). Each of the legs 19 can be described as being in a "fully folded" position (shown in FIG. 20, FIG. 2 and FIG. 1) when the upper leg 24 thereof is flexed up at the hip joint 34 to occupy the fully flexed position relative to the lower torso 14, when the lower leg 26 is flexed up at the knee joint 28 to occupy the fully flexed position relative to the upper leg 24, and when the foot 32 is flexed up at the ankle joint 30 to occupy the fully flexed position relative to the lower leg 26. It will be understood that the fully flexed position can include positions which are characterized by full flexion of the upper legs 24 at the hip joint or hip 16.

Figure 2:
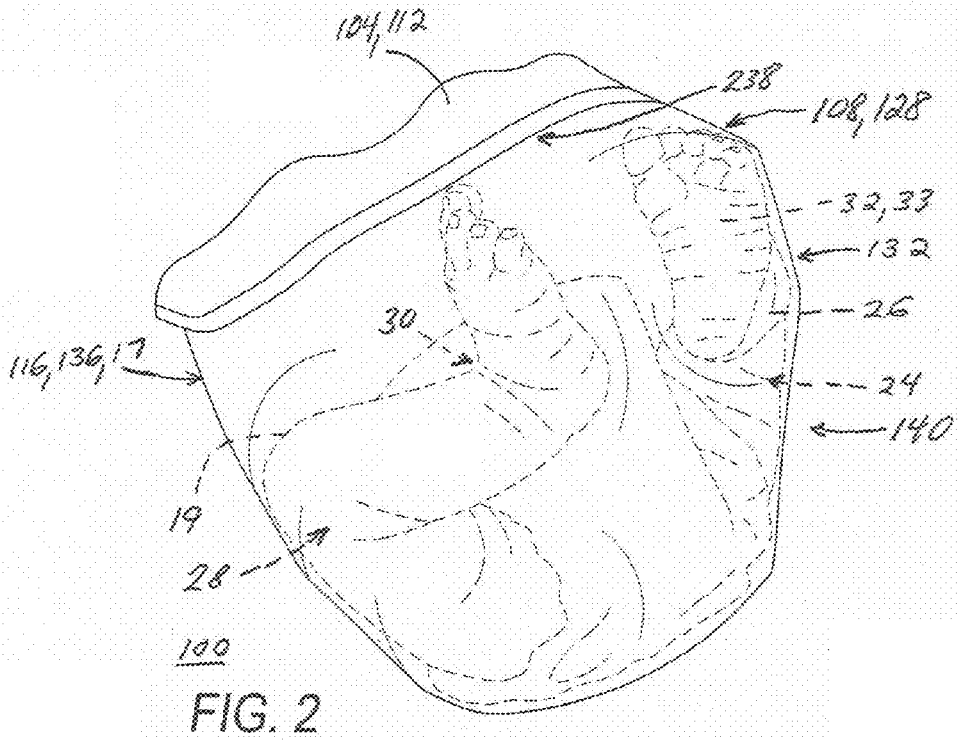
FIG. 2 is an enlarged partial front perspective view of apparatus shown generally in FIG. 1, with phantom lines illustrating obscured details of the infant legs in a full fetal tuck position inside the apparatus.
Figure 3:
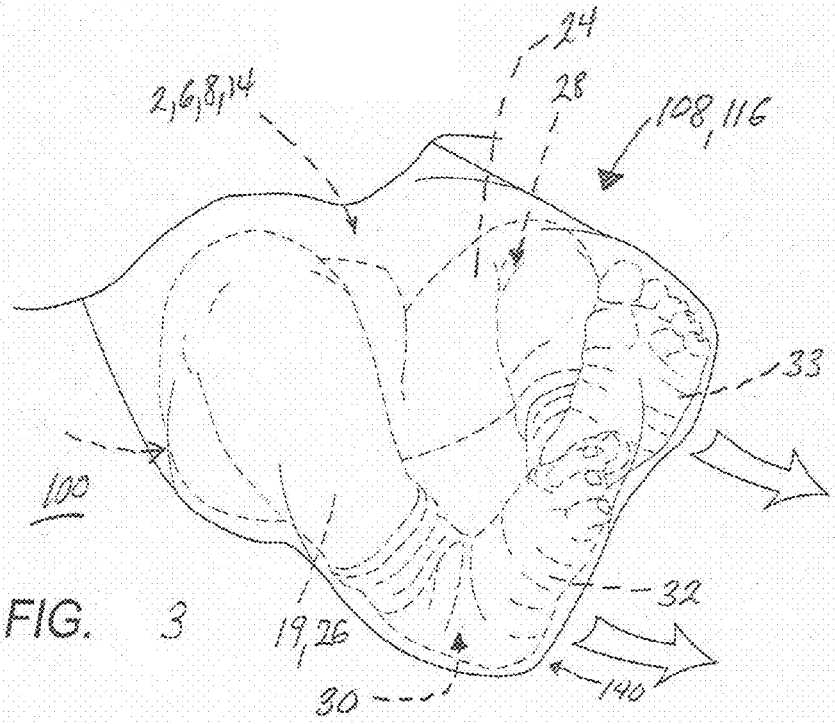
FIG. 3 is an enlarged partial front perspective view similar to FIG. 2, with phantom lines illustrating obscured details of the infant legs occupying a partial tuck position.
Figure 4:
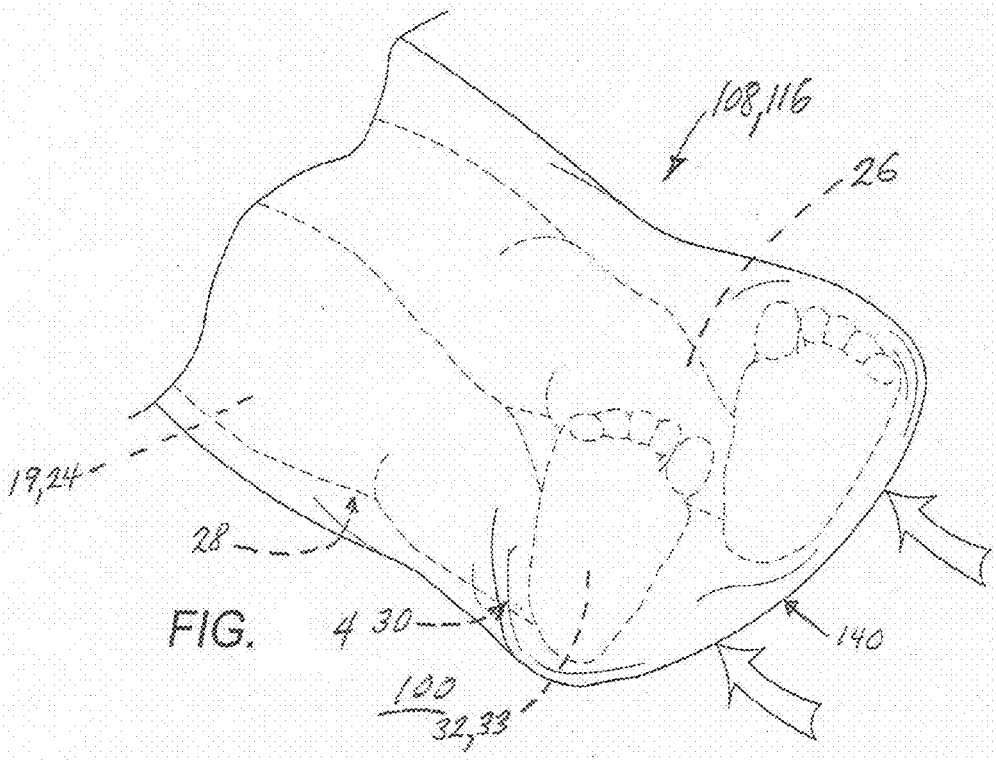
FIG. 4 is an enlarged partial front perspective view similar to FIG. 3, with phantom lines illustrating obscured details of the infant legs occupying a fully extended position.

It will be understood that the legs 19 of infant 2 occupy a "full fetal tuck" position best shown in FIG. 20 and FIG. 2 when both legs 19 simultaneously occupy "fully folded" positions. In the "full fetal tuck" position, in each leg 19 the upper leg 24 is flexed up at the hip 16 to occupy the fully flexed position relative to the lower torso 14, when the lower leg 26 is flexed up at the knee joint 28 to occupy the fully flexed position relative to the upper leg 24, and the foot 32 is flexed up at the left ankle joint 30 to occupy the fully flexed position relative to the lower leg 26. It will be understood that the legs 19 of infant 2 can occupy any of numerous "partial tuck" positions (an exemplary partial tuck position being shown in FIG. 3). The legs 19 simultaneously can occupy the same or different conditions which are partial tuck positions wherein one or more of the hip 16, knee joint 28, and ankle joint 30 occupy partially folded positions. It will be appreciated that the specific partial tuck position shown in FIG. 3 is only one among a range of potential combinations which are characterized as partial tuck positions. It will be understood that the partial tuck positions (such as shown in FIG. 3, for example) of the legs 19 are intermediate the "full fetal tuck" position (FIG. 1, FIG. 2 and FIG. 20) and the "fully extended" (shown in FIG. 4) position. In the "fully extended" position (not shown), it will be understood that each of the hip 16, knee joint 28 and ankle joint 30 occupy a "fully unfolded" position.

Figure 12:
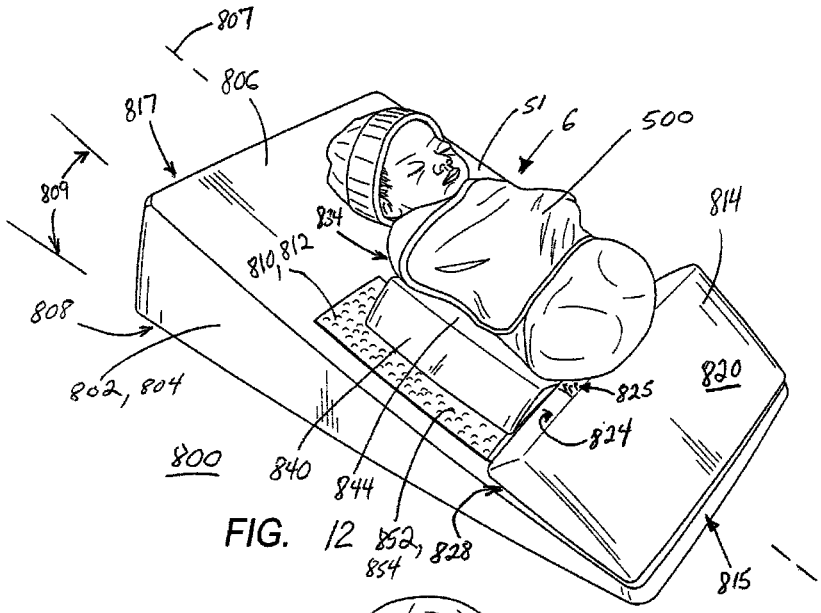
FIG. 12 is an elevated top perspective view similar to FIG. 1, showing apparatus for care of an infant according to a fifth embodiment.
Figure 11:
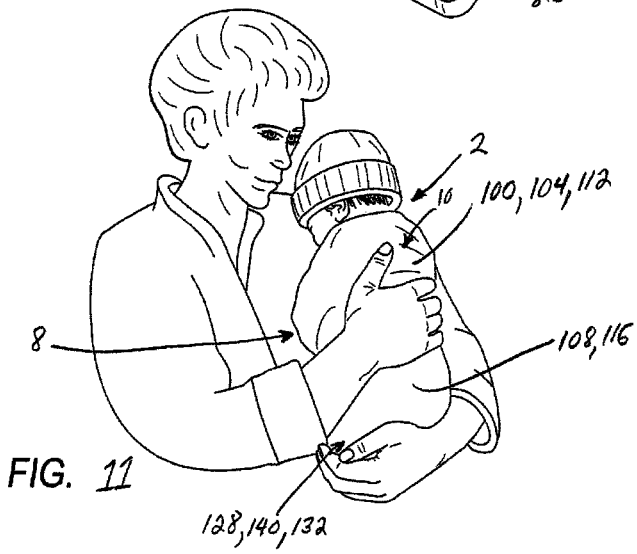
FIG. 11 is a front perspective view of apparatus for care of an infant according to a first embodiment as shown generally in FIG. 1, with the apparatus having the infant disposed therein with legs in a full fetal tuck position, and the apparatus and infant therein being cradled in the arms of a attendant.

FIG. 1 is an elevated front perspective view of apparatus for care of an infant 2 according to an embodiment, and having infant 2 disposed therein with legs (not shown in FIG. 1) in a full fetal tuck position. FIG. 2 is an enlarged partial front perspective view of the apparatus 100 shown generally in FIG. 1, with phantom lines illustrating obscured details of the infant legs 19 in a full fetal tuck position inside the apparatus 100. It will be understood that a primary support 50 supports at least a portion of apparatus 100, and thus torso 6 of infant 2, in a substantially stable condition. As can be observed in FIG. 1, in the specific embodiment illustrated in FIG. 1, primary support 50 is independent of apparatus 100. It will be appreciated that, in other embodiments, apparatus 100 can be formed or joined with primary support 50, such as by hook and loop fastener material as further described in this disclosure. In the specific embodiment illustrated in FIG. 1, primary support 50 is a suitable flat bed. Primary support 50 has a primary support surface 52 which acts through apparatus 100 and engages the back 10 of torso 6 in a manner that supports infant 2 in a substantially stable condition. In the specific embodiment illustrated in FIG. 1, primary support surface 52 extends in a generally horizontal plane. It will be appreciated that primary support surface 52 can extend in any other suitable plane. It will be appreciated that torso 6 of infant 2 can be supported in any stable position. For example, primary support 50 can include or can be defined by the arms, shoulder or chest of an attendant, such as a parent or attendant, cradling infant 2. FIG. 11 is a front perspective view of apparatus 100 for care of an infant according to a first embodiment as shown generally in FIG. 1, with the apparatus 100 having infant 2 disposed therein with legs 19 in a full fetal tuck position, and the apparatus 100 having infant 2 disposed therein being cradled together in the arms of a attendant. In other embodiments, primary support 50 can include or can be defined by any other suitable support which supports torso 6 of infant 2 in a substantially stable condition. It will be appreciated that torso 6 of infant 2 can occupy any of various resting positions at different angles other than a generally horizontal plane, depending upon the configuration of the primary support 50. For example, FIG. 12 is an elevated top perspective view similar to FIG. 1, showing, in combination, apparatus 100 having infant 2 disposed therein, and inclined support apparatus 700 for supporting both apparatus 100 and infant 2 disposed therein. It will be understood that inclined support apparatus 700 includes inclined primary support surface 708. It will be understood that the inclined primary support surface 708 is inclined relative to a horizontal plane at an inclined support angle 712. Inclined support apparatus 700 is further described elsewhere in this specification.

Returning to FIG. 20, it will be observed that when torso 6 of infant 2 is supported by primary support 50, absent infant 2 being confined in apparatus 100, arms 13 and legs 19 are independently movable relative to torso 6 due to muscular activity relating to these limbs. It will be appreciated by those skilled in the art that excessive independent movement of the arms 13 or legs 19 relative to torso 6 can cause the infant to experience a startle effect. It will be appreciated by those skilled in the art that in some circumstances excessive independent movement of the arms 13 or legs 19 relative to torso 6 can contribute to instability of torso 6 relative to primary support 50. It will be appreciated that excessive movement of arms 13 or legs 19 relative to torso 6 can wake infant 2 when sleeping. It will be understood that repeated excessive movement of arms 13 or legs 19 relative to torso 6 can repeatedly wake infant 2 when sleeping. It will be appreciated by those skilled in the art that excessive independent movement of the arms 13 or legs 19 relative to torso 6 which causes the infant to experience a startle effect can wake infant 2 when sleeping. It will be appreciated by those skilled in the art that repeated acts of excessive independent movement of the arms 13 or legs 19 relative to torso 6 which causes the infant to repeatedly experience a startle effect can repeatedly wake infant 2 when sleeping. It will be appreciated that excessive movement of arms 13 or legs 19 relative to torso 6 can unsettle or disturb infant 2 when sleeping or resting. It will be appreciated that repeated excessive movement of arms 13 or legs 19 relative to torso 6 can repeatedly unsettle or disturb infant 2 when sleeping or resting. It will be appreciated by those skilled in the art that excessive independent movement of the arms 13 or legs 19 relative to torso 6 which causes the infant to experience a startle effect can unsettle or disturb infant 2 when sleeping or resting. It will be appreciated by those skilled in the art that repeated excessive independent movement of the arms 13 or legs 19 relative to torso 6 which causes the infant to repeatedly experience a startle effect can repeatedly unsettle or disturb infant 2 when sleeping or resting.

Figure 5:
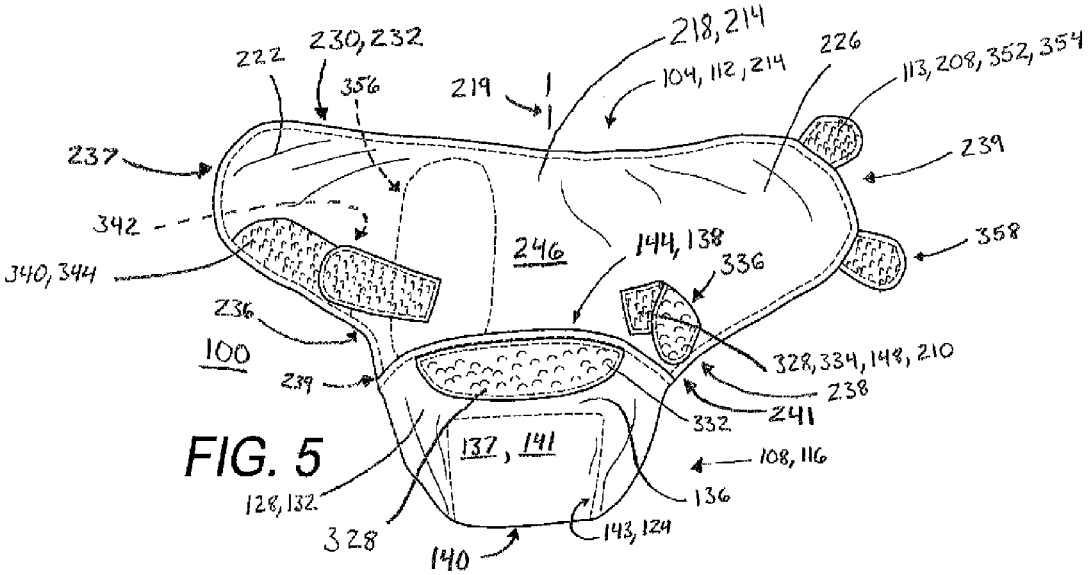
FIG. 5 is a front perspective view of the apparatus shown generally in FIG. 1, showing the apparatus in a flat, unfolded condition and ready to receive an infant (not shown).
Figure 6:
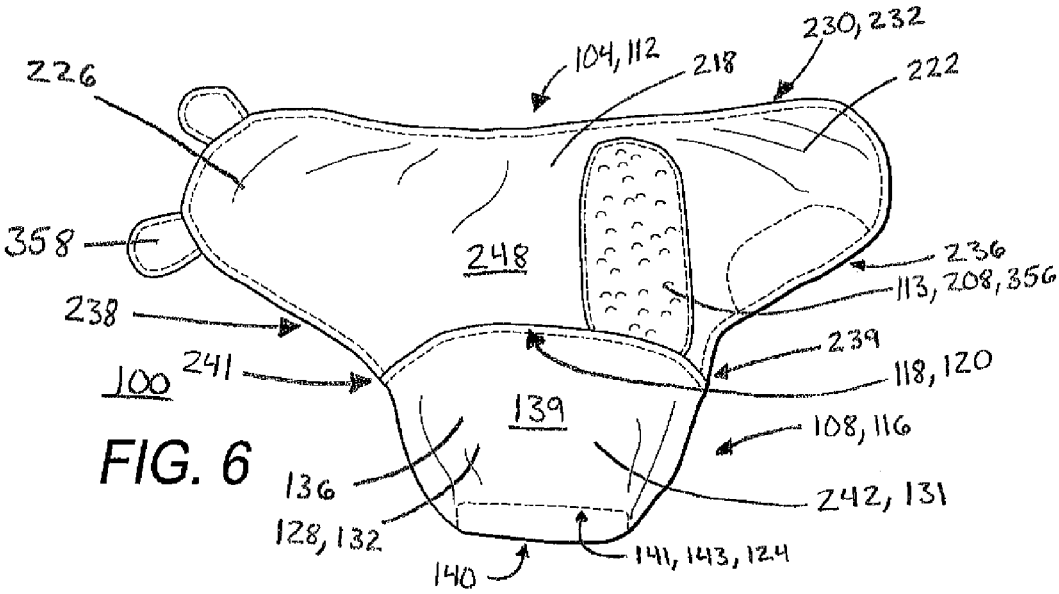
FIG. 6 is a rear perspective view of the apparatus shown generally in FIG. 5, showing the apparatus in a flat, unfolded condition and ready to receive an infant (not shown).

FIG. 5 is a front perspective view of the apparatus shown generally in FIG. 1, showing the apparatus in a flat, unfolded condition and ready to receive an infant (not shown in FIG. 5). As shown in FIG. 5, apparatus 100 includes an upper section 104 and a lower section 108. FIG. 6 is a rear perspective view of the apparatus shown generally in FIG. 5, showing the apparatus in a flat, unfolded condition and ready to receive an infant (not shown in FIG. 6). As shown in FIG. 6 from a rear perspective, it is observed that apparatus 100 includes an upper section 104 and a lower section 108. Referring again to FIG. 5, the upper section 104 is substantially formed and defined by a first elastic fabric material 112. It will be understood that materials described herein are suitably breathable for use in contact with an infant 2. It will be understood that materials described herein are suitably flexible for use in contact with an infant 2. It will be understood that fabric material as described herein can include any otherwise suitable woven or nonwoven material which is suitable for use with an infant 2. In the specific embodiment shown in FIG. 5, the lower section 108 is substantially formed and defined by a second elastic fabric material 116. It will be understood that, although different specific constructions are contemplated, in the particular embodiment illustrated in FIG. 5, the second elastic fabric material 116 includes and is formed of a plurality of layers 17 (shown in FIG. 2) of fabric materials, as further described elsewhere in this disclosure. In the specific embodiment illustrated in FIG. 5, the upper section 104 and lower section 108 are joined in intimate fixed relationship in a suitable manner. In the specific embodiment illustrated in FIG. 5, the upper section 104 and lower section 108 are joined in intimate fixed relationship by a suitable fastener combination 118. In the specific embodiment illustrated, upper section 104 and lower section 108 are joined by a fastener combination 118 (shown in FIG. 6) which includes an elongated, substantially continuous stitched seam 120. In other embodiments (not shown), at least portions of both the upper section 104 and lower section 108 can be formed of and can include a single piece of common fabric material. In other embodiments (not shown), the upper section 104 and lower section 108 are joined together in fixed relationship by another suitable fastener combination 118 such as, for example, a zipper seam, a glue seam, a rigid material such as plastic material, by hook and loop fastening material such as Velcro®, a plurality of buttons and buttonholes, or by any other suitable fastener combinations.

Returning to FIG. 5, in the specific embodiment illustrated, the upper section 104 is substantially formed of first elastic fabric material 112. The first elastic fabric material 112 is a suitable material that can be stretched to bind the arms 13 snug against the torso 6 (see FIG. 1) and can be maintained in stretched condition by engagement of suitable first releasable fastener combinations 113. It will be understood that upper portion 104 can be configured in any suitable manner. In the specific embodiment illustrated in FIG. 5, the upper portion 104 is substantially defined by the first elastic fabric material 112. Upper portion 104 includes a major upper fabric panel 214. Major upper fabric panel 214 is formed substantially of the first elastic fabric material 112. Major upper fabric panel 214 includes upper rear section 218. Upper rear section 218 is sized and oriented to receive and face back 10 of torso 6 when infant 2 is received in apparatus 100. It will be understood that infant 2 is positioned with the spine (not shown) generally aligned along longitudinal axis 219. Upper rear section 218 is oriented and sized to receive and face the back 10 of torso 6 in substantially abutting relationship therewith. Major upper fabric panel 214 includes first wrap section 222. First wrap section 222 extends outwardly from upper rear section 218 in a first peripheral direction (relative to the longitudinal direction of longitudinal axis 219) corresponding to the right side of infant 2. Major upper fabric panel 214 includes second wrap section 226. Second wrap section 226 is spaced apart from first wrap section 222 by upper rear section 218. Second wrap section 226 extends outwardly from upper rear section 218 in a second peripheral direction corresponding to the left side of infant 2. Major upper fabric panel 214 has a substantially continuous primary outer edge 230. Primary outer edge 230 includes upper edge portion 232. Upper edge portion 232 is defined by cooperation of corresponding upper edge segments of upper rear section 218, first wrap section 222, and second wrap section 226. Upper edge portion 232 is generally oriented to define a neck area 234 (see FIG. 1) of apparatus 100 when infant 2 is received in apparatus 100. Again referring to FIG. 5, primary outer edge 230 includes a first lower edge portion 236 defined by first wrap section 222 and spaced from upper edge portion 232 in generally opposed relationship to upper edge portion 232. It is observed that first lower edge portion 236 joins upper edge portion 232 at a first transition section 237. First lower edge portion 236 extends between first transition section 237 and first terminus 231. Primary outer edge 230 includes a second lower edge portion 238 defined by second wrap section 226 and spaced from upper edge portion 232 in generally opposed relationship to the upper edge portion 232. It is observed that second lower edge portion 238 joins upper edge portion 232 at a second transition section 239. Second lower edge portion 238 extends between second transition section 239 and second terminus 241. It will be understood that upper rear section 218 of major upper fabric panel 214 is joined in fixed intimate relationship with corresponding lower rear section 242 of pouch 132 of lower portion 108. More particularly, major upper fabric panel 214 at upper rear section 218 is joined in intimate fixed relationship with corresponding lower rear section 242 of pouch 132 of lower portion 108 along substantially continuous stitched seam 120 (shown in FIG. 6). Referring to FIG. 6, stitched seam 120 extends between first terminus 239 and second terminus 241 in a generally circumferential direction to form an integral connection between upper rear section 218 and lower rear section 242 of apparatus 100. Cooperation of upper rear section 218 and lower rear section 242 thus provides a substantially continuous major rear fabric panel assembly which is a fabric member extending from upper edge portion 232 to bottom of pouch 132. Referring to FIG. 5, major upper fabric panel 214 has a major inner surface 246. Referring to FIG. 6, major upper fabric panel 214 has a major outer surface 248 disposed in opposed relationship to major inner surface 246. Referring to FIG. 5, major inner surface 246 is oriented to face and contact infant 2 (not shown in FIG. 5). Referring to FIG. 1, major outer surface 248 is oriented to face the external environment.

In the specific embodiment shown in FIG. 6, stitched seam 120 extends in a circumferential direction between first terminus 239 and second terminus 241 and is located in the rear 131 of apparatus 100 at a location approximately in opposition to mouth portion 144 (see FIG. 5) of pouch 132 of swaddle 128. Referring to FIG. 6, upper portion 104 at stitched seam 120 thus is joined in fixed relationship to the secondary elastic fabric material 116 which defines pouch sidewall 136. Upper portion 104 extends toward the upper edge 232 from the stitched seam 120 and is defined by first elastic fabric material 112 which when wrapped about torso 6 (shown in FIG. 1) defines a conforming, elastic cocoon that engages and quiets arms 13 against torso 6.

Referring to FIG. 5, infant 2 (not shown) is placed on upper middle section 218 with back 8 on major inner surface 246 and the spine of infant 2 aligned generally along longitudinal axis 219, and with legs 19 inserted through mouth portion 144 into pouch 132. Pouch 132 is pulled up in the longitudinal direction generally toward upper edge 232 to fully fold the pair of legs 19 in the full fetal tuck position. The first wrap section 222 is wrapped across torso 6 by pulling first wrap section 222 at first transition 237 across front 8 of torso 6 and right arm 13 from right to left to draw right arm 13 snug against front 8 of torso 6. The second wrap section 226 is wrapped over first wrap section 222 and across torso 6 be pulling second wrap section 226 at second transition 239 across front 8 of torso 6 and left arm 13 from left to right to draw left arm 13 snug against first wrap section 222 on front 8 of torso 6.

Referring to FIG. 5, mouth portion 144 of pouch 132 is configured to be opened by a attendant to insert legs 19 (see FIG. 2) and lower torso 14 of infant 2 inside pouch 132 of swaddle 128. The upper cocoon section 223 conforms tightly to upper torso 12 to quiet the arms 13 in relationship to torso 6. The tight upper cocoon section 223 is defined by the upper section 104 and quiets arms 13, in combination with the swaddle 128 quieting legs 19, enables infant 2 to sleep continuously without waking and in a relatively undisturbed manner without disruption for relatively long periods. The tight upper cocoon section 313 quieting the arms 13, in combination with swaddle 128 quieting legs 19, enables infant 2 when awake to rest in a relatively undisturbed manner.

It will be understood that top portion 104 and bottom portion 108 each include elements of releasable fastener combinations 312. It will be understood that, according to embodiments, top portion 104 and bottom portion 108 can include any suitable releasable fastener combinations 312. In the specific embodiment illustrated in FIG. 5 and FIG. 6, top portion 104 and bottom portion 108 each include elements of releasable fastener combinations 312 which are landing areas 315. Each landing area 315 includes a suitable mating component of a releasable fastener combination 312. It will be understood that any suitable releasable fastener combination 312 can be used. In the particular embodiment illustrated in FIG. 5 and FIG. 6, each releasable fastener combination 312 includes a suitable mating pair of releasable soft hook and loop fastener components 318. It will be understood that, in the specific embodiment shown in FIG. 5 and FIG. 6, each releasable soft hook and loop fastener component 318 is identified as either a male or hook landing area 320 or a mating female or loop landing area 322. Respective of the hook landing areas 320 and corresponding loop mounting areas 322 are configured for releasable mating engagement with each other.

In the specific embodiment illustrated in FIG. 5 and FIG. 6, bottom portion 108 and top portion 104 include respective components of primary releasable fastener combination 328. More specifically, bottom portion 108 includes a primary support female landing area 332 defined on pouch sidewall 136 adjacent mouth portion 144 of pouch 132, and top portion 104 includes a spaced pair of primary support male landing areas 334. In the specific embodiment illustrated in FIG. 5 and FIG. 6, it will be understood that, in the specific embodiment illustrated, the pair of primary support male landing areas 334 are substantially identical and are disposed in spaced relation to each other on respective flexible fabric flaps 336. Each of the fabric flaps 336 is joined in intimate fixed relationship with upper rear section 218 above mouth portion 144 of pouch 132. It will be understood that primary support female landing area 332 is configured for releasable mating engagement with the pair of primary support male landing areas 334 to provide primary support which fastens or maintains mouth portion 144 of pouch 132 in a fixed position relative to the legs 19 of infant 2 in the direction of longitudinal axis 219.

In the specific embodiment illustrated in FIG. 5 and FIG. 6, top portion 108 includes mating elements of a secondary releasable fastener combination 340. Secondary releasable fastener combination 340 includes a spaced pair of secondary support male landing areas 342 and a mating secondary support female landing area 344. The pair of secondary support male landing areas 342 (best shown in FIG. 8) are disposed in opposition to the pair of primary support male landing areas 334 and supported by respective of the fabric flaps 336. Referring again to FIG. 5, secondary support female landing area 344 is disposed in first wrap section 222. More particularly, secondary support female landing area 344 is disposed on major inner surface 246 adjacent first lower edge 236 of first wrap section 222. Secondary support female landing area 344 is configured for releasable mating engagement with the pair of secondary support male landing areas 342 to support the opposing primary support male landing areas 334 in fixed positions relative to longitudinal axis 219, and thus provides secondary support which contributes to fastening or maintaining mouth portion 144 of pouch 132 in the fixed position relative to legs 19 of infant 2 as established by releasable engagement of primary releasable fastener combination 328.

In the specific embodiment illustrated in FIG. 5 and FIG. 6, top portion 108 includes mating elements of a tertiary releasable fastener combination 352. Tertiary releasable fastener combination 352 includes a spaced pair of tertiary male landing areas 354 and a mating tertiary female landing area 356. The pair of tertiary male landing areas 354 are disposed on respective outer fabric ears 358 located at transition section 239 of outer edge 230 of second wrap section 226 and face in the same orientation as major inner surface 246. The tertiary female landing area 356 is disposed on major outer surface 248 of upper rear section 218. It will be understood that with first wrap section 222 pulled around front 8 of torso 6, second wrap section 226 is pulled around front 8 of torso 6 and forms an overlapping layer over first wrap section 222. When second wrap section 226 is pulled over first wrap section 222, tertiary male landing areas 354 are joined in releasable mating engagement with tertiary female landing area 356 to securely close both second wrap section 226 and first wrap section 222. It will be understood that pouch upper edge 138 can be selectively positioned along longitudinal axis 219 to draw or fold the legs 19 into a full fetal tuck position, and thereafter is retained in substantially the same location along longitudinal axis 219 by cooperation of primary releasable fastener combination 328 and secondary releasable fastener combination 340 to anchor pouch upper edge 138 relative to primary fabric panel 214 of top portion 108 and torso 6.

It will be understood that landing areas 315 are formed of suitable soft mating hook (male) and loop (female) releasable fastener components 318. Soft hook and loop fastener components 318 are suitably soft to avoid irritating the skin or otherwise agitating infant 2. One commercially available product suitable for use as a soft hook and loop fastener component 318 is Soft and Flexible Velcro, available from Textol Systems, Inc. of Carlstadt, N.J.

In the specific embodiment illustrated in FIG. 1, the second elastic fabric material 116 possesses relatively limited elasticity and thus exhibits a relatively high resistance to being stretched from an initial condition by application of dislocation force. A relevant example of such "dislocation force" would be force applied to the second elastic fabric material 116 by the soles 33 of the feet 32 upon muscular activity which extends the legs 19 for the feet 32 to kick out against or push out against the second elastic fabric material 116. Another relevant example of such a "dislocation force" would be force applied to the second elastic fabric material 116 by the knees 28 and upper legs 24 upon muscular activity which forces the knees 28 and upper legs 24 to widen apart and thus to push out against the second elastic fabric material 116 in the sideways direction. In the specific embodiment illustrated in FIG. 1, the second elastic fabric material 116 also possesses a relatively great "return factor" or "return index" and, upon being stretched from an initial condition to a stretched condition, returns to the initial condition when dislocation force applied to the second elastic fabric material 116 by muscular activity of the legs 19 falls below a threshold value which is necessary to continue or maintain stretching or dislocation of the second elastic fabric material 116 from the initial condition. It will be understood that when the second elastic fabric material 116 returns to the initial condition from the stretched condition, the legs 19 are generally urged toward and substantially return to initial locations of legs 19.

An exemplary chain of events will be described for the legs 19 and the second elastic fabric material 116. First, the legs 19 initially occupy the "full fetal tuck" position with the second elastic fabric material 116 occupies an initial low stretch condition which is snug against the soles 33 of both feet 32 and otherwise generally snug against the sides of the legs 19. Second, when the legs 19 are initially urged by muscular action from the "full fetal tuck" position towards a partially folded position and thus apply dislocation forces to the second elastic fabric material 116, the second elastic fabric material 116 exhibits limited stretchiness and resists being stretched and thus applies opposing resistance forces to the legs 19 through the feet 32 until the dislocation forces exceed the limited stretchiness factor and thus cause the second elastic fabric material 116 to be stretched or dislocated to a stretched condition corresponding to a partially folded position of the legs 19. Third, when muscular forces on the legs 19 are reduced and thus cause dislocation forces generated by the muscles and legs 19 to fall below the resistance forces inherent in the second elastic fabric material 116 when in the stretched condition, the differential resistance forces cause the legs 19 and feet 32 to be urged back to the initial "full fetal tuck" positions as the second elastic fabric material 116 returns from the stretched condition to the initial stretch condition.

It will be understood that, where lower section 108 is positioned about legs 19 and lower torso 14 with the legs 19 each occupying an initial position, the lower section 108 is selectively positionable relative to infant 2 such that the second elastic fabric material 116 in the initial stretch condition is snug against the feet 32 of each leg 19. It will be understood that the "initial position" can be, for example, the "full fetal tuck" position wherein both legs 19 simultaneously occupy the "fully folded" position, or any position wherein the legs 19 occupy any combination of "partially folded" positions. In the specific embodiment illustrated in FIG. 4, the lower section 108 is selectively positionable relative to infant 2 such that the second elastic fabric material 116 in the initial stretch condition is sufficiently snug against the feet 32 of each leg 19 to generate a resistance force against the feet 32 when muscular action urges the legs 19 to move or unfold from the initial position and thus generate dislocation forces against the second elastic fabric material 116 of lower section 108. If the muscular action is sufficiently strong to cause any portion of the legs 19 to move or unfold from the initial position despite application of the resistance force against the feet 32 and any other portions of the legs 19, then the second elastic fabric material 116 continues to apply resistance forces against the feet 32 and against any other portions of the legs 19 in contact therewith to cause the feet 32 and legs 19 to move and fold back to the initial position. More particularly, in the specific embodiment illustrated in FIG. 4, the lower section 108 is selectively positionable relative to infant 2 such that the second elastic fabric material 116 in the initial stretch condition is sufficiently snug against the feet 32 of each leg 19 to generate a resistance force against the feet 32 which comforts the infant 2 by opposing muscular action which can urge the legs 19 to move or unfold from the initial position. The lower section 108 including the second elastic fabric material 116 thus defines a comfort support 124. Comfort support 124 is selectively positionable relative to infant 2 such that the second elastic fabric material 116 in the initial stretch condition is sufficiently snug against the feet 32 of each leg 19 to generate resistance force against the feet 32 which comforts and quiets the infant 2 by opposing muscular action which can urge the legs 19 to move or unfold from the initial position and, should the legs 19 move away from the initial position to a second or dislocated position, the comfort support 124 comforts the infant 2 by returning the legs 19 to the initial position. The comfort support 124 thus quiets the legs 19 of infant 2 by generating resistance forces against the soles 33 of feet 32 and legs 19, the resistance forces urging the feet 32 and legs 19 to the initial position. It will be understood that, when the initial position is the full fetal tuck position, the comfort support 124 thus quiets the legs 19 of infant 2 by generating resistance forces against the soles 33 of feet 32 and legs 19, the resistance forces urging the feet 32 and legs 19 back to the full fetal tuck position. It will be understood that, when the initial position is a partially folded position, the comfort support 124 thus quiets the legs 19 of infant 2 by generating resistance forces against the soles 33 of feet 32 and legs 19, the resistance forces urging the feet 32 and legs 19 back to the partially folded position. It will be understood that, according to embodiments, it is not necessary for the legs 19 and feet 32 to be returned to the specific initial position initially occupied in order for the comfort support 124 to provide comfort forces which are sufficient to comfort and quiet the legs 19 and infant 2.

Referring to FIG. 2, it will be understood that lower section 108 including second elastic fabric material 116 can be formed in any configuration which causes the second elastic fabric material 116 in the initial stretch condition to be sufficiently snug against any portions of the feet 32 of the legs 19 to cause the second elastic fabric material 116 to exert resistance forces against the feet 32 when either leg 19 is urged by muscular action to attempt to move away from the initial "fully folded" (identified as the "full fetal tuck" position when both legs 19 occupy a "fully folded" position) towards any of the numerous possible combinations of "partially folded" positions (shown generally in FIG. 3) and "fully extended" positions (shown generally in FIG. 4) of the legs 19. It will be understood that at any instant each leg 19 can occupy a position different from the other, i.e., one leg can be in a "fully folded" position and the other can be in a "partially folded" position, for example. As shown in FIG. 1, the lower section 108 defines a swaddle 128. Referring to FIG. 3, swaddle 128 defines a pouch 132. Pouch 132 has a generally continuous pouch sidewall 136. Pouch sidewall 136 is formed of the second elastic fabric material 116. Pouch sidewall 136 includes a pouch front wall section 137 which defines a continuous pouch upper edge 138. Pouch upper edge 138 extends generally in a circumferential direction between first terminus 239 and second terminus 241 and is substantially perpendicular to longitudinal axis 219. Pouch sidewall 136 defines and includes a continuous pouch rear wall section 139. Pouch rear wall section 139 is opposite from pouch front wall section 137 and is integrally joined therewith to form pouch 132, except at pouch upper edge 138. Pouch upper edge 138 is disposed in opposition to pouch rear wall section 139. Cooperation of pouch upper edge 138 and rear wall section 139 defines open mouth portion 144. Pouch sidewall 136 defines a continuous, enclosed pouch bottom portion 140. Pouch bottom portion 140 is spaced from pouch upper edge 138 and mouth portion 144 of pouch 132. Mouth portion 144 opens to accommodate the lower torso 14 and legs 19.

Referring again to FIG. 5, pouch sidewall 136 and pouch 132 are formed and defined by second elastic fabric material 116. It will be understood that second elastic fabric material 116 has properties, as described elsewhere in this specification, providing comfort by providing resistance force opposing extension of legs 19 and return force to return legs 19 from the fully extended position (shown in FIG. 4) and partial tuck position (shown in FIG. 3) to the full fetal tuck position (shown in FIG. 1). It will be understood that, in the specific embodiment illustrated in FIG. 5, second elastic fabric material 116 provides and defines comfort support 124. It will be understood that second elastic fabric material 116 can be of any construction suitable to provide the necessary properties. Construction of the second elastic fabric material 116 in the particular embodiment illustrated in FIG. 5 will be described. Second elastic fabric material 116 forming pouch sidewall 136 includes two discrete material layers 117 throughout pouch 132 and includes a third discrete material layer of resistance material 143 in comfort support area 141. The discrete material layers are aligned face to face in a sandwich construction. Comfort support area 141 is indicated by dashed lines on pouch front wall section 137 in FIG. 5 and on pouch rear wall section 139 in FIG. 6, the dashed lines generally indicating a continuous stitched seam (not shown). The stitched seam joins the third discrete layer of resistance material 143 between an outermost layer 147 and an innermost layer (not shown). In the specific embodiment illustrated, the outermost layer 147 and innermost layer (not shown) are identical and are formed of 90/10 cotton—lycra blend jersey stretch knit fabric having a nominal weight of 6.5 oz. A commercially available product suitable to form outermost layer 147 and the identical innermost layer is 90/10 cotton—lycra blend jersey stretch knit fabric having a nominal weight of 6.5 oz, available from Lucy's Fashion Fabrics and Trims in Anna, Tex. In the specific embodiment illustrated, the resistance material 143 is formed of lightweight, ventilated neoprene material. A suitable commercially available product suitable to form resistance material 143 is 1.5 mm perforated neoprene, grade 1, available from Foamorder.com in San Francisco, Calif. It will be understood that comfort support area 141 is continuous and extends around pouch bottom 140 between pouch front wall section 137 and pouch rear wall section 139. It will also be understood that, in the specific embodiment illustrated in FIG. 5 and FIG. 6, the distinction between pouch bottom 140, pouch front wall section 137 and pouch rear wall section 139 in comfort support area 141 is arbitrary, being provided here for ease of description, and that readily discernable boundaries are not visible in the pouch 132 from an external perspective.

Pouch 132 and top portion 104 include adjustable locating structure 148. Adjustable locating structure 148 is selectively and adjustably engageable to permit the second elastic fabric material 116 in the initial stretch condition to be positioned or located in the longitudinal direction (indicated by longitudinal axis 219) to be sufficiently snug against portions of feet 32 of legs 19 to cause the second elastic fabric material 116 to exert resistance forces against the feet 32 when either leg 19 is urged by muscular action to attempt to move away from the initial position, the initial position being either the "fully folded" position or any of the numerous possible combinations of "partially folded" positions. In the specific embodiment shown in FIG. 5, the adjustable locating structure 148 includes the primary releasable fastener combination 328 and the secondary releasable fastener combination 340, which are described in detail elsewhere in this specification. It will be understood that adjustable locating structure 148 includes primary support female landing area 332 defined on pouch sidewall 136 adjacent and immediately below pouch upper edge 138 of pouch front section 136. In other embodiments (not shown), adjustable locating structure 148 can include any suitable releasable fastening combination that enables the pouch upper edge 138 to be selectively positioned in the longitudinal direction to locate the pouch bottom portion 140 snug against the feet 32 in the initial condition. It will be understood that adjustable locating structure 148 includes the pair of primary support male landing areas 334 on top portion 104. The pair of primary support male landing areas 334 are selectively releasably engageable with the primary support female landing area 332 to selectively support and fix the pouch upper edge 138 in a location or position located along the longitudinal axis 219 suitable to draw up and locate the pouch bottom portion 140 snug against the feet 32 to fold the legs 19 in the full fetal tuck position, which is the typical initial condition of legs 19.

Referring to FIG. 5, it will be understood that adjustable locating structure 148 includes the pair of secondary support male landing areas 342 of top portion 104, which are located in immediate opposed relationship and face in the opposite direction relative to the pair of primary support male landing areas 334. It will be understood that adjustable locating structure 148 includes the secondary support female landing area 344 of first wrap section 222 of top portion 104. The secondary support female landing area 344 is selectively releasably engageable with the pair of secondary support male landing areas 342 to selectively support and fix the primary releasable fastener combination 328, and thus the pouch upper edge 138, in an established location or position located along the longitudinal axis 219, where the established location of pouch upper edge 138 has been established by selective releasable engagement of the primary releasable fastener combination 328 to draw up and locate the pouch bottom portion 140 snug against the feet 32 to fold the legs 19 in the full fetal tuck position. It is to be understood that the pair of primary support male landing areas 334, the opposing pair of secondary support male landing areas 342, and the secondary support female landing area 344 are located relative to longitudinal axis 219 at positions generally above and between pouch upper edge 138 and upper edge 230 of top portion 104, such that releasable mating engagement of the primary releasable fastener combination 328 simultaneous with releasable mating engagement of the secondary releasable fastener combination 340 provides supporting force which is sufficient to maintain the pouch 132, pouch upper edge 138 and pouch bottom portion 140 in a substantially fixed position or location throughout numerous repeating cycles of extension and folding of legs 19 between the full fetal tuck position, partial tuck positions, and the fully extended position.

Referring to FIG. 2, according to embodiments, the comfort support 124 is adapted to support each of the legs 19 relative to the lower torso 14 in a respective initial position or full fetal tuck position. In the initial positions of the legs 19 each of the upper legs 24 occupies an initial folded position relative to the lower torso 14. In the initial folded position, each of the upper legs 24 is flexed at the hip joint 34 relative to the lower torso 14. In the initial position of the legs 19 each of the feet 32 occupies a respective initial foot location relative to the torso 6. The comfort support 124 is selectively configurable relative to the infant 2 in an initial location (shown in FIG. 2). The initial comfort location of the comfort support 124 corresponds to the initial positions of the legs 19. The comfort support 124 in the initial location engages each of the feet 32 when the feet 32 occupy the initial foot locations (shown in FIG. 2). When engaging the feet 32, the comfort support 124 applies against the feet 32 respective resistance forces, the resistance forces urging the feet 32 to occupy the initial foot locations such that the upper legs 24 are urged to occupy the initial folded positions. The comfort support 124 is engageable by the feet 32 for the feet 32 to apply displacement forces against the comfort support 124. The displacement forces are caused by muscular activity of the legs, and the displacement forces urge the comfort support to be displaced from the initial comfort location. Referring to FIG. 5, apparatus 100 includes adjustable locating structure 148. Adjustable locating structure 148 is selectively configurable by a attendant to cooperate with the comfort support 124 to substantially retain the comfort support 124 in the initial location and to return the comfort support 124 back to the initial location when dislocated from the initial location by dislocation forces generated by muscular action of the legs 19. It will be understood that the adjustable locating structure 148 cooperates with the comfort support 124 to substantially retain the comfort support 124 in the initial location when the comfort support 124 is repeatedly subjected to displacement forces. At least one of the adjustable locating structure 148 and the comfort support 124 is selectively configurable by a attendant to free the comfort support 124 from supporting legs 19 and to permit unconstrained movement of legs 19. The comfort support 124 when free is movable relative to the infant 2 and when free can be readily displaced from an initial location when the comfort support 124 is repeatedly subjected to displacement forces imparted by legs 19. During a subsequent comfort period, the comfort support 124 is substantially retained in an initial location by mating engagement of the primary releasable fastener combination 328 and secondary releasable fastener combination 340 of the adjustable locating structure 148. The comfort period endures until ended by a attendant freeing the comfort support 124 for substantial movement relative to the infant 2 and away from the initial location by releasing the primary releasable fastener combination 328 and secondary releasable fastener combination 340 of the adjustable locating structure 148.

According to embodiments, the adjustable locating structure 148 is selectively configurable by an attendant to be engaged in an anchoring relationship with at least one of the following: the torso 6, the primary support 50, and secondary structure 51 which is independent of infant 2 and primary support 50. The adjustable positioning structure 148 when engaged in the anchoring relationship is anchored in a substantially fixed relationship with the at least one of the following: the torso 6, the primary support 50, and the secondary structure 51. Upon being anchored in the substantially fixed relationship, the adjustable positioning structure 148 is selectively configurable by an attendant to cooperate with the comfort support 124 to substantially anchor the comfort support 124 in the initial location when the comfort support 124 is repeatedly subjected to displacement forces. The adjustable positioning structure 148 includes anchoring structure 210. Anchoring structure 210 is configured to cooperate in an anchoring relationship with an anchor 215 (shown in FIG. 1). Anchor 215 is defined by and includes at least one of the following: torso 6, primary support 50, and secondary structure 51 (shown in FIG. 12). Returning to FIG. 1, it will be understood that anchor 215 is an object independent of the legs 19. In the specific embodiment illustrated in FIG. 1, the anchor 215 includes torso 6, as will be further described. In the specific embodiment illustrated in FIG. 12, anchor 215 includes torso 6 and secondary structure 51. Returning to FIG. 1, it will be understood that anchoring structure 210 is engaged in a substantially fixed relationship with anchor 215. Before the substantially fixed relationship is established with anchor 215, anchoring structure 210 is selectively positionable relative to the anchor 215 to fix the pouch bottom portion 140 defining comfort support 124 in the initial location by establishing slight tension in the second elastic fabric material 116 in relation to the anchor 215 and feet 32, the tension causing the second elastic fabric material 116 to be snug against the feet 32 in the initial foot positions corresponding to the full fetal tuck position. Cooperation of the anchoring structure 210 and anchor 215 thus allows the comfort support 140 defined by the layer of resistance material 143 in comfort support area 141 of second elastic fabric material 116, including the pouch bottom portion 140, to generate resistance forces against feet 32 and thus against legs 19. In the specific embodiment shown in FIG. 4, anchoring structure 210 includes the entirety of top portion 104, which is configured to be tightly engaged in substantially fixed relationship with torso 6. It will be understood that torso 6 thus functions as anchor 215 in the specific embodiment illustrated. In embodiments, the anchoring structure 210 is configured to engage in substantially fixed relationship an anchor 215, where the anchor 215 includes at least one of torso 6 (shown in FIG. 1), primary support 50 (shown in FIG. 1) and secondary structure 51 (shown in FIG. 12). It will be understood that anchoring structure 210 includes top portion 104 when wrapped to form a tight cocoon about torso 6, the primary releasable fastener combination 328, and the secondary releasable fastener combination 340, which cooperate to engage anchor 215 or torso 6. It will be understood that any suitable anchoring structure 210 can engage anchor 215. In embodiments (not shown), cooperation of the anchoring structure 210 with anchor 215 enables the comfort support 140 defined by the layer of resistance material 143 in comfort support area 141 of the second elastic fabric material 116 at the pouch bottom portion 140 to generate resistance forces against feet 32 and thus against legs 19. In the specific embodiment shown in FIG. 1, anchoring structure 210 is configured to engage in substantially fixed relationship the anchor 215, which is defined by torso 6. In embodiments (not shown), anchoring structure 210 can include the following: a tie, a fastener, hook and loop fastening material, a button and buttonhole, a snap-fit button, a zipper, a hook, a strap, a buckle, a carabiner, an eyelet, a clip, or a pin.

It will be understood that lower portion 108 including swaddle 128 having the second elastic fabric material 116 defining pouch 132 substantially retains the legs 19 in the initial positions by engagement of the swaddle bottom portion 140 with the feet 32 in the initial foot locations. The pouch sidewall 136 defined by the second elastic fabric material 116 is disposed to apply supplemental confining forces against at least one of the following: the ankles 30, the lower legs 26, the knees 28, the upper legs 24, and the hips 16. The supplemental confining forces tend to urge the legs 19 to conform to the full fetal tuck position and to remain in the initial or full fetal tuck position for the purpose of quieting the legs 19 of infant 2. It will be understood that with the legs 19 occupying the initial full fetal tuck position, the second elastic fabric material 116 defines the swaddle 128 in tight relationship with the legs 19 and is temporarily deformable to accommodate momentary displacement of the legs 19 from the initial positions. The swaddle 128 quieting the legs 2 enables infant 2 to sleep continuously without waking and in a relatively undisturbed manner without disruption for relatively long periods. The swaddle 128 also enables infant 2 when awake to rest in a relatively undisturbed manner. Different overall sizes of swaddle 128 and pouch 132 are desired to fit different sizes of infants. For example, premature babies as small as about 3 pounds will require a considerably smaller apparatus 100 providing different amounts of comfort forces than, for example, infants weighing about 20 pounds several months after birth. For example, it is observed that pouch 132 in an initial condition can have a suitable volume of about 1200 to about 1300 cubic centimeters to contain the legs 19 and lower abdomen 14 of an infant weighing about 20 lbs. It will be observed that pouch 132 can be of any suitable volume.

Figure 7:
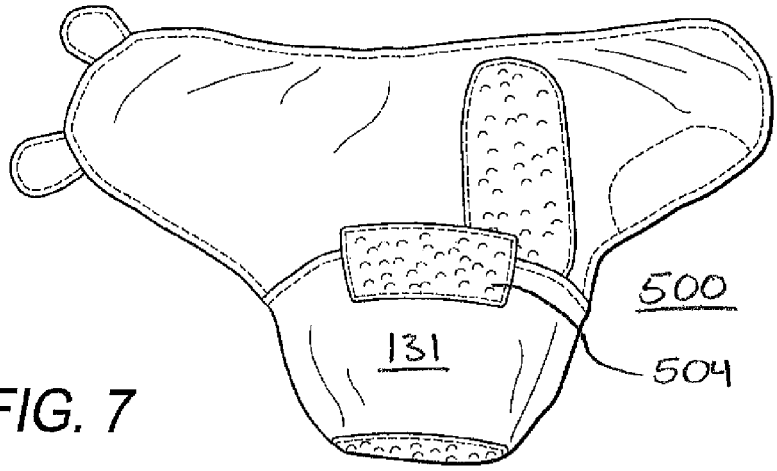
FIG. 7 is a rear perspective view similar to FIG. 6, showing a second embodiment of apparatus for care of an infant and adapted for use in cooperation with a bed apparatus (not shown in FIG. 7), the apparatus being in a flat, unfolded condition and ready to receive an infant (not shown).

FIG. 7 illustrates apparatus 500 according to an embodiment. Apparatus 500 is generally identical to apparatus 100, except as otherwise described in this paragraph or as illustrated in FIG. 7. Apparatus 500 at rear section 131 includes external releasable female landing area 504. External releasable female landing area 504 is selectively engageable in releasable mating engagement with an exterior releasable male landing area 808 (shown in FIG. 13) of a bed system 800 to prevent infant 2 from moving away from an initial location (shown in FIG. 12) on bed system 800.

Figure 8:
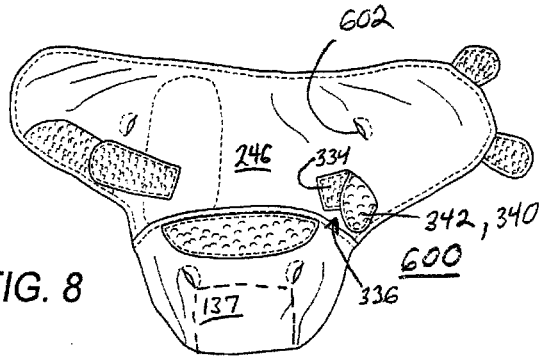
FIG. 8 is a front perspective view similar to FIG. 5, showing a third embodiment of apparatus for care of an infant and adapted for use with medical monitoring equipment, the apparatus being in a flat, unfolded condition and ready to receive an infant (not shown).
Figure 9:
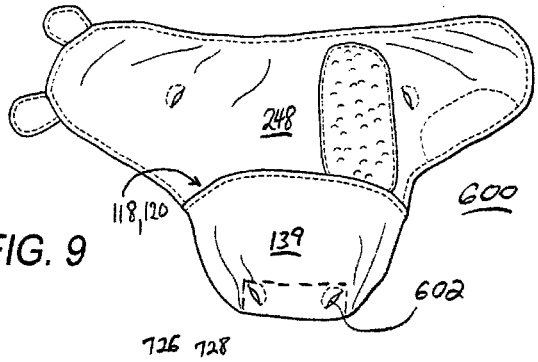
FIG. 9 is a rear perspective view of the apparatus shown generally in FIG. 8, showing the apparatus in a flat, unfolded condition and ready to receive an infant (not shown).

FIG. 8 and FIG. 9 illustrate apparatus 600 according to an embodiment. Apparatus 600 is generally identical to apparatus 100, except as otherwise described in this paragraph or as illustrated in FIG. 8 and FIG. 9. FIG. 8 is a front perspective view similar to FIG. 5, showing an embodiment which is apparatus 600 for care of an infant and adapted for use with medical monitoring equipment (not shown), the apparatus 600 being in a flat, unfolded condition and ready to receive an infant (not shown). FIG. 9 is a rear perspective view of the apparatus shown generally in FIG. 8. It is observed that apparatus 600 includes a plurality of open equipment ports 602. Each equipment port 602 is sized and positioned to permit monitoring equipment (not shown) to extend through apparatus 600 for contacting the infant (not shown).

Figure 10:
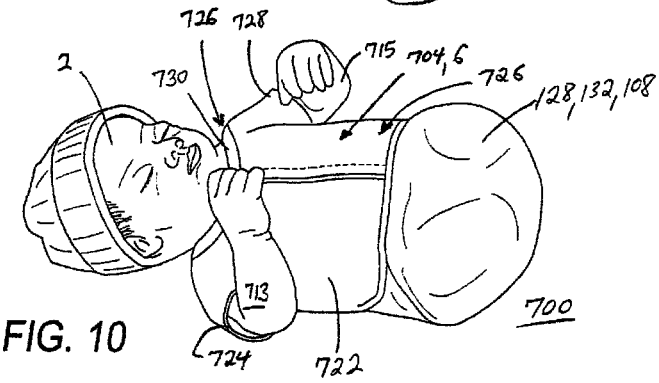
FIG. 10 is an elevated front perspective view of apparatus for care of an infant according to a fourth embodiment, an infant being disposed therein with legs in a full fetal tuck position.

FIG. 10 illustrates apparatus 700 for care of an infant according to an embodiment. Apparatus 700 is generally identical to apparatus 100, except as otherwise described in this paragraph or as illustrated in FIG. 10. FIG. 10 is an elevated front perspective view of apparatus 700 for care of an infant according to an embodiment, and having an infant 2 disposed therein with legs 19 in a full fetal tuck position. Except as otherwise described in this paragraph or shown in FIG. 10, apparatus 700 is identical to apparatus 100. Apparatus 700 has an upper portion 704 having a pair of sleeves 708 for accommodating the arms 13 of infant 2. It will be understood that first wrap section 722 is identical to first wrap section 222 of apparatus 100, except that first wrap section 722 includes a respective first sleeve 724 in proximity to upper edge 726, the first sleeve 724 being configured to receive the respective right arm 713. It will be understood that second wrap section 726 is identical to second wrap section 226 of apparatus 100, except that second wrap section 722 includes a respective second sleeve 728 in proximity to upper edge 726, the second sleeve 728 being configured to receive the respective left arm 715. Upper edge 726 defines a neck area 730 intermediate first sleeve 724 and second sleeve 728. It will be understood that first sleeve 724 and second sleeve 728 permit movement of the arms relative to the torso 6 to allow the infant 2 to move the arms, such as by reaching out.

Figure 13:
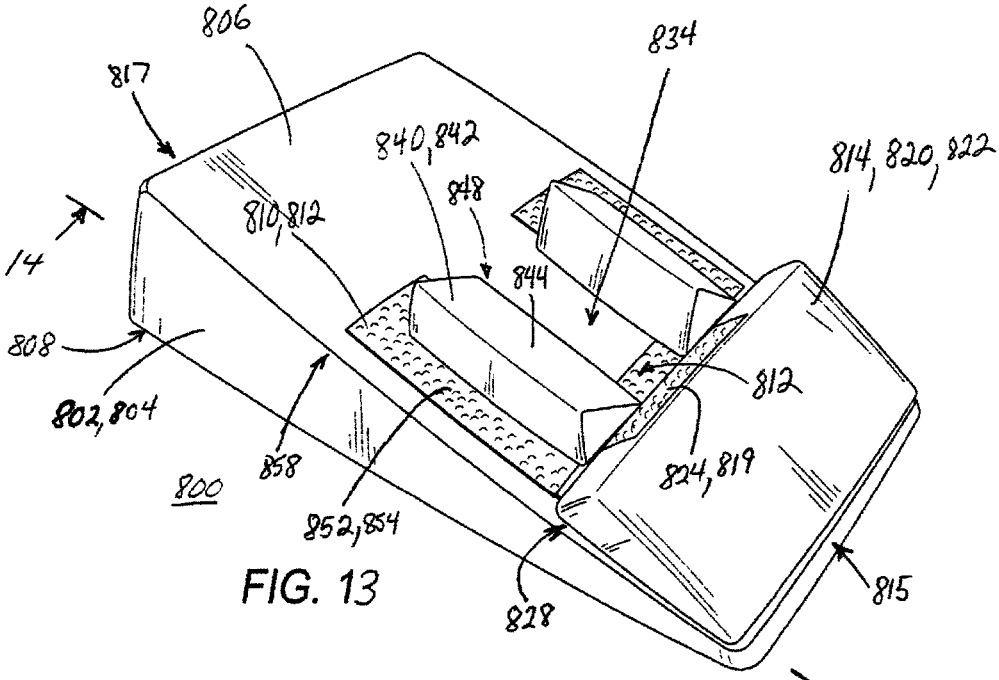
FIG. 13 is an elevated top perspective view similar to FIG. 12, showing apparatus for care of an infant according to an embodiment.
Figure 14:
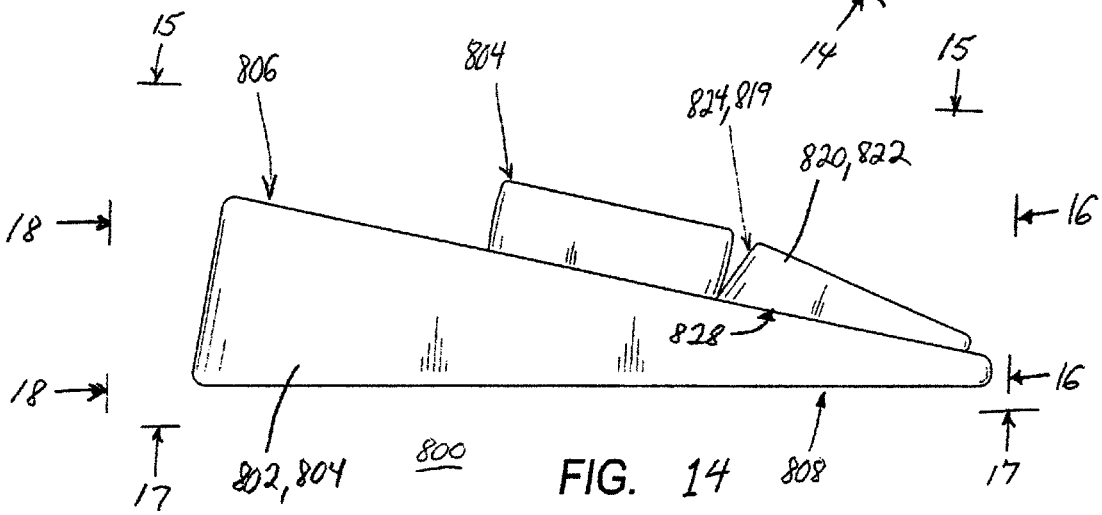
FIG. 14 is a side elevation view taken generally along line 14-14 in FIG. 13, showing apparatus for care of an infant.
Figure 16:
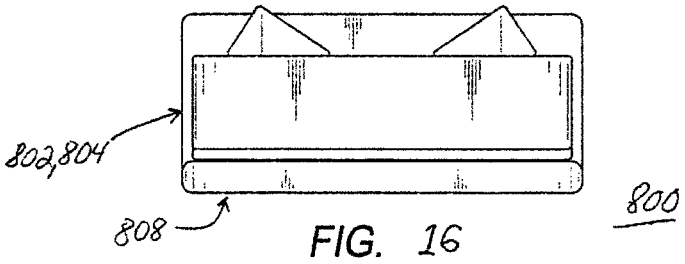
FIG. 16 is a first end elevation view taken generally along line 16-16 in FIG. 14, showing apparatus for care of an infant.
Figure 15:
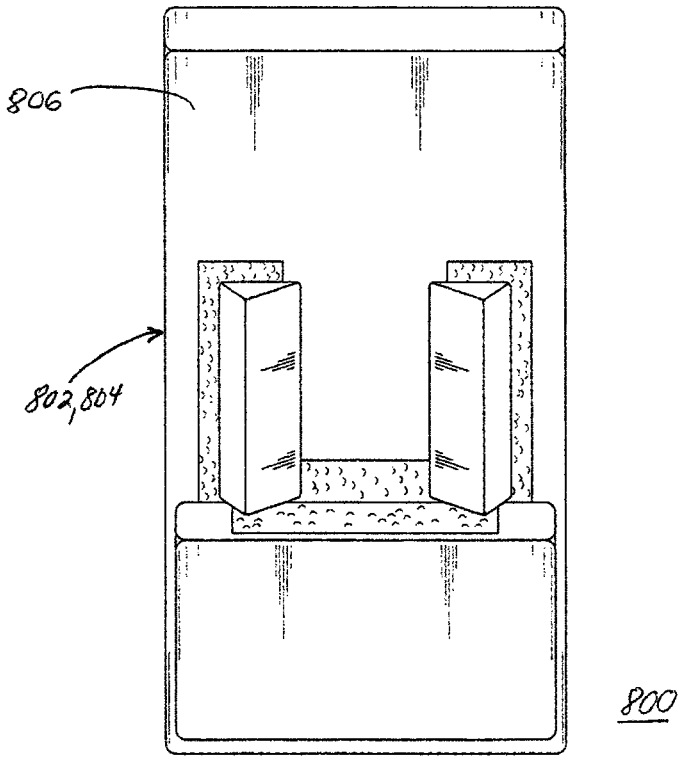
FIG. 15 is top elevation view taken generally along line 15-15 in FIG. 14, showing apparatus for care of an infant.
Figure 18:
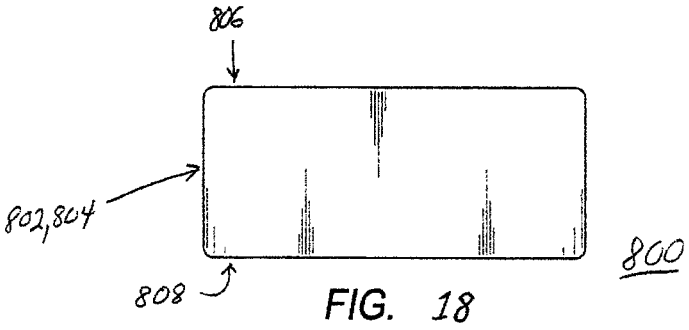
FIG. 18 is a second end elevation view taken generally along line 18-18 in FIG. 14, showing apparatus for care of an infant.
Figure 17:
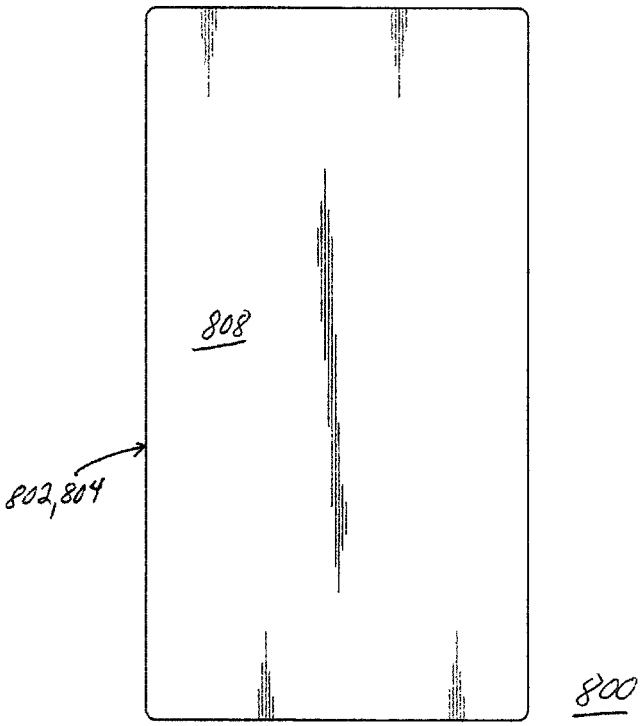
FIG. 17 is a bottom elevation view taken generally along line 17-17 in FIG. 14, showing apparatus for care of an infant.
Figure 19:
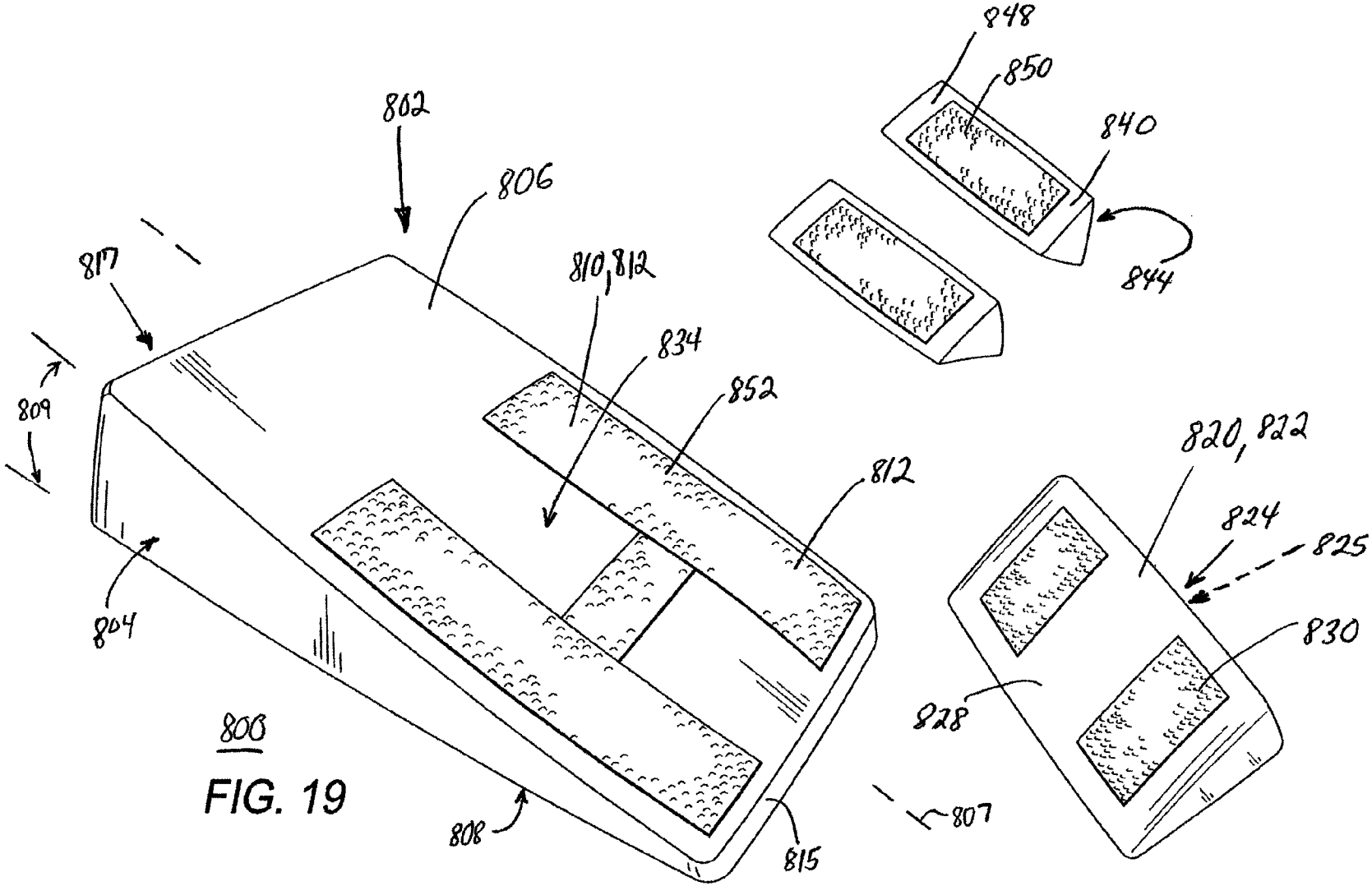
FIG. 19 is an exploded perspective view similar to FIG. 12, showing further detail of apparatus for care of an infant according to an embodiment.

FIG. 12, FIG. 13, FIG. 14, FIG. 15, FIG. 16, FIG. 17, FIG. 18 and FIG. 19 illustrate apparatus 800 for care of an infant according to an embodiment. FIG. 12 is an elevated top perspective view similar to FIG. 1, showing apparatus 800 for care of an infant according to an embodiment, wherein apparatus 800 for care of an infant includes apparatus for supporting an infant according to an embodiment. In FIG. 12, apparatus 800 for care of an infant according to an embodiment is shown in combination with apparatus 500 for care of an infant according to an embodiment. It will be understood that, in the specific embodiment illustrated in FIG. 12, apparatus 500 for care of an infant is similar to the embodiment previously shown in FIG. 7. FIG. 13 is an elevated top perspective view similar to FIG. 12, showing apparatus 800 for care of an infant, wherein apparatus 800 includes apparatus for supporting an infant according to an embodiment. FIG. 14 is a side elevation view taken generally along line 14-14 in FIG. 13, showing apparatus 800 for care of an infant. FIG. 15 is top elevation view taken generally along line 15-15 in FIG. 14, showing apparatus 800 for care of an infant. FIG. 16 is a first end elevation view taken generally along line 16-16 in FIG. 14, showing apparatus 800 for care of an infant. FIG. 17 is a bottom elevation view taken generally along line 17-17 in FIG. 14, showing apparatus 800 for care of an infant. FIG. 18 is a second end elevation view taken generally along line 18-18 in FIG. 14, showing apparatus 800 for care of an infant. FIG. 19 is an exploded perspective view similar to FIG. 12, showing further detail of apparatus 800 for care of an infant according to an embodiment.

Referring to FIG. 12, apparatus 800 for care of an infant includes apparatus for supporting an infant which is a bed system 802. Bed system 802 for supporting an infant includes primary inclined support member 802. Primary inclined support member 802 is formed of a wedge-shaped piece of cellular foam material (not shown) providing suitable support for infant 2 laying thereupon in an supine position. It will be observed that infant 2 in the supine position is supported and maintained in an inclined position or orientation, with the head elevated above the feet. It will be understood that maintaining infant 2 in an inclined orientation when laying on its back in a supine position promotes uninterrupted periods of undisturbed sleep and rest. It will be understood that maintaining infant 2 in an inclined orientation with head elevated above feet provides health benefits. In the specific embodiment shown in FIG. 12, cellular foam material is foam material conforming to applicable standards for use in infant bedding. For example, in the particular embodiment shown, cellular foam material conforms to standards for infant bedding materials established by appropriate authorities or bodies. One commercially available product which is suitable cellular foam material is Foam #F1844 Lt. Blue from Danna Foam Company of Houston, Tex. Primary inclined support member 802 includes a removable primary fitted fabric liner 804 which closely fits and encloses the wedge-shaped piece of cellular foam material. One commercially available product which is suitable fabric liner is Baby-Dry material available from Vitex Fabrics Inc. of New York, N.Y. Primary inclined support member 802 has an inclined upper surface 806. Inclined upper surface 806 has a bed longitudinal axis 807. Primary inclined support member 802 has a bottom surface 808 which extends in a generally horizontal orientation to rest upon a fixed support (not shown) such as a flat bed mattress in a crib. Bottom surface 808 is disposed in an opposing orientation relative to inclined upper surface 806. In the specific embodiment shown, an incline angle 809 of about 30 degrees to about 35 degrees is defined between inclined upper surface 806 and horizontal bottom surface 808. It will be understood that any suitable incline angle 809 between about 5 degrees and about 45 degrees can be defined by primary inclined support member 802. Primary fitted fabric liner 804 at inclined upper surface 806 includes components of releasable fastener combinations 810. More particularly, primary fitted fabric liner 804 at inclined upper surface 806 includes a plurality of primary releasable fastener female landing areas 812 (shown in FIG. 19) which are suitable for releasable mating engagement with respective releasable fastener male landing areas (shown in FIG. 19) of respective selectively positionable mating components 814. It will be understood that primary inclined support member 802 has a lower end 815 and an elevated upper end 817, such that inclined upper surface 806 is inclined between lower end 815 and upper end 817. Inclined upper surface 806 defines an infant bay 834 for receiving infant 2 (not shown in FIG. 19). Infant bay 834 is an inclined, generally rectangular area bisected by bed longitudinal axis 807. Infant bay 834 is defined between a spaced pair of tertiary rest members 840. Infant bay 834 is located between a secondary rest member 820 and upper end 817, such that secondary rest member 820 is located below infant bay 834 along the inclined upper surface 806.

Bed system 800 includes secondary rest member 820. Secondary rest member 820 is a minor wedge-shaped member and is suitably formed of the same type of cellular foam material (not shown) as primary inclined support member 802, where the cellular foam material is enclosed in a respective secondary fitted fabric liner 822. Secondary rest member 820 defines a secondary rest surface 824 extending generally perpendicular to inclined upper surface 806 of primary inclined support member 802. Secondary rest member 820 includes a secondary bottom surface 828 which substantially abuts inclined upper surface 806 in face to face relationship therewith. Secondary bottom surface 828 includes a secondary releasable fastener male landing area 830 (shown in FIG. 19) suitable for releasable mating engagement with a respective primary releasable fastener female landing area 812 (shown in FIG. 13) of the primary inclined support member 802, where the primary releasable fastener female landing area 812 occupies a primary rest position 832 on inclined upper surface 806. Primary rest position 832 is located between an infant bay 834 (shown in FIG. 13) and lower end 815 of inclined upper surface 806. It will be understood that secondary rest member 820 is selectively positionable to provide support in the direction of the incline to prevent infant 2 from sliding down inclined upper surface 806 in the direction of the bed longitudinal axis 806. In the specific embodiment illustrated in FIG. 13, secondary rest surface 824 has a rest surface releasable male landing area 825 (shown in FIG. 12) disposed thereon for releasable mating engagement with external releasable female landing area 504 of apparatus 500 (external releasable female landing area 504 shown in FIG. 7). Referring to FIG. 12, it will be understood that secondary rest surface 824 prevents infant 2 and apparatus 500 from sliding down towards lower end 815 from infant bay 834. It will be understood that in an alternative configuration, apparatus 100 can be used with primary inclined support member 802 and secondary rest member 820 without having external releasable female landing area 504. It will be understood that from time to time secondary rest member 820 is selectively positionable relative to bed longitudinal axis 807 to support infant 2 when positioned in infant bay 834, by positioning secondary rest surface 824 to abut buttocks of the infant 2 in a desired location along the bed longitudinal axis 807, and attaching the secondary releasable fastener male landing area 830 (FIG. 19) in releasable mating engagement with the pair of primary releasable fastener female landing areas 812 (FIG. 13) of the primary inclined support member 802, as may vary during growth of infant 2.

Bed system 800 includes a pair of tertiary side rest members 840 located adjacent infant 2 on inclined upper surface 806. Each of the tertiary side rest members 840 is substantially identical. In the specific embodiment illustrated, tertiary side rest member 840 is a minor elongated, wedge-shaped member and is suitably formed of the same type of cellular foam material (not shown) as primary inclined support member 802, where the cellular foam material is enclosed in a respective secondary fitted fabric liner 842. In the specific embodiment illustrated, each elongated wedge-shaped member has a height of about three (3) inches and an overall length of about twelve (12) inches. It will be understood that different specific dimensions and shapes are contemplated. For example, each tertiary side rest member 840 can have the shape of an elongated block (not shown). Tertiary side rest member 840 defines a tertiary rest surface 844 extending upward from inclined upper surface 806 of primary inclined support member 802. Tertiary rest member 840 includes a tertiary bottom surface 848 which substantially abuts inclined upper surface 806 in face to face relationship therewith. Tertiary bottom surface 848 includes a tertiary releasable fastener male landing area 850 (shown in FIG. 19) suitable for releasable mating engagement with a respective tertiary releasable fastener female landing area 852 of the primary inclined support member 802, where the tertiary releasable fastener female landing area 852 occupies a tertiary side rest position 854 on inclined upper surface 806. In the specific embodiment shown in FIG. 19, it will be understood that the tertiary releasable fastener female landing area 852 is contiguous with the primary releasable fastener female landing area 812. In other embodiments, these can be non-contiguous. Tertiary side rest position 854 is located between infant bay 834 and a respective outer edge 858 of inclined upper surface 806. It will be understood that the pair of tertiary side rest members 840 are selectively positionable to provide side to side stability to prevent infant 2 from rolling onto its side, and also to prevent infant 2 from accidentally rolling off outer edge 858. It will be understood that the pair of tertiary side rest members 840 can be selectively positioned in the direction of the bed longitudinal axis 807 to cooperate with secondary rest member 820 to prevent an infant 2 of any size from rolling off either side 858. It will be understood that embodiments of bed system 800 are adjustable to support infant 2 in an inclined position (shown in FIG. 12) during sleep and rest. It will be understood that embodiments of bed system 800, that are apparatus for support of an infant, used in combination with embodiments of apparatus (100, 500, etc.) for care of an infant promote periods of continuous sleep in an undisturbed state by an infant 2.

According to embodiments, apparatus for care of an infant are described. According to embodiments, apparatus for support of an infant are described. Although specific embodiments are illustrated and described herein, it will be appreciated by those of ordinary skill in the art that any arrangement which is calculated to achieve the same purpose may be substituted for the specific embodiments shown. This application is intended to cover any adaptations or variations. One of ordinary skill in the art will appreciate that implementations can be made for other embodiments that provide the required function. In particular, one of skill in the art will readily appreciate that names of apparatus are not intended to limit embodiments. Furthermore, additional apparatus can be added to the components, functions can be rearranged among the components, and new components corresponding to future enhancements and physical devices used in embodiments can be introduced, without departing from the scope of embodiments. The terminology used in this application is meant to include all environments and alternate technologies which provide the same functionality as described herein.

I claim:

1. An apparatus for care of an infant, the apparatus comprising:

a lower section having a pouch configured for receiving the legs and lower torso of the infant, wherein the pouch is further configured to: (i) snuggly support each of the legs relative to the lower torso in a fetal tuck position, (ii) stretch when the infant's legs apply a dislocation force to the pouch, and (iii) generate a resistance force that urges the infant's legs back into the fetal tuck position once the dislocation force falls below a threshold value;

wherein the pouch comprises a pouch front wall section, a pouch bottom, a pouch rear wall section and a comfort support area that extents from the pouch front wall section, around the pouch bottom and up the pouch rear wall section; and wherein the pouch is formed so as to include two discrete layers of a first elastic fabric material, and wherein in the comfort support area, the pouch is further formed of a third discrete layer of a resistance material, which is sandwiched between the two discrete layers of the first elastic fabric material to provide an even greater resistance force; and an upper section having an upper fabric panel configured for receiving at least an upper torso of the infant, wherein the upper section comprises a pair of fabric flaps, which are joined to an inner surface of the upper fabric panel above an upper edge of the pouch and configured to wrap around the lower torso of the infant to attach to the upper edge of the pouch.

2. The apparatus as recited in claim 1, wherein the first elastic fabric material possesses limited elasticity, so that when the infant's legs apply the dislocation force to the pouch, the limited elasticity of the first elastic fabric material helps to generate the resistance force that urges the infant's legs back into the fetal tuck position once the dislocation force falls below the threshold value.

3. The apparatus as recited in claim 1, wherein a size and a shape of the pouch are such that when the infant is secured within the apparatus, the first elastic fabric material of the pouch is generally snug against the infant's feet and the sides of the infant's legs when the infant is in the fetal tuck position.

4. The apparatus as recited in 1, wherein the first elastic fabric material comprises a breathable stretch knit fabric.

5. The apparatus as recited in 1, wherein the upper section and the lower section each comprise mating elements of releasable fastener combinations, which cooperate to retain an upper edge of the pouch in substantially the same location along a longitudinal axis of the apparatus when the pouch is subjected to the dislocation force applied by the infant's legs.

6. The apparatus as recited in claim 5, wherein the mating elements of the releasable fastener combinations are selected from a group consisting of a tie, a fastener, a hook and loop material, a button, a zipper a hook, a strap, a buckle, a carabiner, an eyelet, a clip and a pin.

7. The apparatus as recited in claim 1, wherein the pair of fabric flaps comprise mating elements of releasable fasteners, which are disposed on a first side of the pair of fabric flaps and configured to releasably engage with mating elements of a releasable fastener disposed on the upper edge of the pouch, and wherein when engaged, the pair of flaps are configured to provide primary support for anchoring the upper edge of the pouch in substantially the same location along a longitudinal axis of the apparatus when the pouch is subjected to the dislocation force applied by the infant's legs.

8. The apparatus as recited in claim 7, wherein the upper fabric panel comprises a first wrap section extending outwardly in a first peripheral direction corresponding to a first side of the infant and a second wrap section extending outwardly in a second peripheral direction corresponding to a second side of the infant, and wherein the first and second wrap sections are configured to be wrapped around a front of the infant's torso, such that the second wrap section overlaps the first wrap section.

9. The apparatus as recited in claim 8, wherein the first wrap section comprises mating elements of a releasable fastener disposed on an inner surface of the first wrap section adjacent to a lower edge of the first wrap section, and wherein when the first wrap section is wrapped around the front of the infant's torso, the mating elements of the releasable fastener disposed on the inner surface of the first wrap section are configured to releasably engage with mating elements of releasable fasteners formed on a second side of the pair of fabric flaps to provide secondary support, which contributes to maintaining the upper edge of the pouch in the substantially same location.

10. The apparatus as recited in claim 8, wherein the upper fabric panel is formed from a second elastic fabric material that is stretched when the first and second wrap sections are wrapped around the infant's torso to form a conforming, elastic cocoon that engages and quiets the arms of the infant.

11. The apparatus as recited in claim 10, wherein the second elastic material comprises a breathable stretch knit fabric.

12. The apparatus as recited in claim 10, wherein the second elastic material of the upper fabric panel and the first elastic material of the pouch are joined in intimate fixed relationship.

13. The apparatus as recited in claim 10, wherein the second elastic material of the upper fabric panel and the first elastic material of the pouch are formed of a single piece of common fabric material.

14. The apparatus as recited in claim 8, wherein the second wrap section comprises a pair of fabric ears located along an outer edge of the second wrap section, and wherein when the first and second wrap sections are wrapped around the infant's torso such that the second wrap section overlaps the first wrap section, mating elements of releasable fasteners disposed on the pair of fabric ears are configured to releasably engage with mating elements of a releasable fastener disposed on an outer surface of the upper fabric panel to securely close the first and second wrap sections.

15. The apparatus as recited in claim 8, wherein the first wrap section and the second wrap section each include a respective sleeve for accommodating the arms of the infant.

16. The apparatus as recited in claim 2, wherein the apparatus includes a plurality of open equipment ports, which are sized and positioned to permit monitoring equipment to extend through the apparatus for contacting the infant.

17. An apparatus for care of an infant, the apparatus comprising:

an upper fabric panel configured for receiving at least an upper torso of the infant, wherein the upper fabric panel is formed from a first elastic material, and wherein the upper fabric panel comprises a first wrap section and a second wrap section, which are configured to wrap around the upper torso of the infant;

a pouch having a rear section coupled to the upper fabric panel and a mouth portion configured for receiving the legs and lower torso of the infant, wherein a size and shape of the pouch is configured to support each of the legs relative to the lower torso in a fetal tuck position, wherein the pouch comprises a pouch front wall section, a pouch bottom, a pouch rear wall section and a comfort support area that extends from the pouch front wall section, around the pouch bottom and up the pouch rear wall section, and wherein the pouch is formed so as to include two discrete layers of a second elastic fabric material possessing limited elasticity, so that when the infant's legs apply a dislocation force to the pouch, the limited elasticity of the second elastic material generates a resistance force that urges the infant's legs back into the fetal tuck position once the dislocation force falls below a threshold value, and wherein in the comfort support area, the pouch is further formed of a third discrete layer of a resistance material, which is sandwiched between the two discrete layers of the second elastic fabric material to provide an even greater resistance force; and a plurality of releasable fasteners disposed on the upper fabric panel and on an upper edge of the pouch, wherein when engaged, the plurality of releasable fasteners anchor the upper edge of the pouch in substantially the same location along a longitudinal axis of the apparatus when the pouch is subjected to the dislocation force applied by the infant's legs.

18. The apparatus as recited in claim 17, further comprising a pair of fabric flaps, which are joined to a middle inner surface of the upper fabric panel and configured to wrap around the lower torso of the infant to attach to the upper edge of the pouch.

19. The apparatus as recited in claim 18, wherein two of the plurality of releasable fasteners are disposed on a first side of the pair of fabric flaps and configured to releasably engage with a third releasable fastener disposed on the upper edge of the pouch.

20. The apparatus as recited in claim 19, wherein a fourth releasable fastener is disposed on an inner surface of the first wrap section adjacent to a lower edge of the first wrap section, and wherein when the first wrap section is wrapped around the front of the infant's torso, the fourth releasable fastener is configured to releasably engage with a fifth and sixth releasable fasteners formed on a second side of the pair of fabric flaps.

21. The apparatus as recited in claim 17, wherein the second wrap section comprises a pair of fabric ears located along an outer edge of the second wrap section, and wherein when the first and second wrap sections are wrapped around the infant's torso such that the second wrap section overlaps the first wrap section, releasable fasteners disposed on the pair of fabric ears are configured to releasably engage with another releasable fastener disposed on an outer surface of the upper fabric panel to securely close the first and second wrap sections.

22. The apparatus as recited in claim 17, wherein the first and second elastic fabric materials comprise a breathable stretch knit fabric.

23. The apparatus as recited in claim 17, wherein the plurality of releasable fasteners comprise soft and flexible hook and loop fasteners.

* * * * *

UNITED STATES PATENT AND TRADEMARK OFFICE

CERTIFICATE OF CORRECTION

PATENT NO. : 8,726,437 B2
APPLICATION NO. : 12/610785
DATED : May 20, 2014
INVENTOR(S) : Hardesty It is certified that error appears in the above-identified patent and that said Letters Patent is hereby corrected as shown below:

IN THE CLAIMS:

Claim 1, col. 20, line 6: replace the word “extents” with the word --extends--

Signed and Sealed this
Twenty-third Day of September, 2014

Michelle K. Lee

Michelle K. Lee
*Deputy Director of the United States Patent and Trademark Office*